US008109495B2

(12) United States Patent
Kikkawa et al.

(10) Patent No.: US 8,109,495 B2
(45) Date of Patent: Feb. 7, 2012

(54) SPINE FORMATION DEVICE, POST-PROCESSING APPARATUS, AND BOOKBINDING SYSTEM

(75) Inventors: Naohiro Kikkawa, Kawasaki (JP); Nobuyoshi Suzuki, Tokyo (JP); Shinji Asami, Machida (JP); Kazuhiro Kobayashi, Kawasaki (JP); Tomohiro Furuhashi, Fujisawa (JP); Kiichiroh Gotoh, Yokohama (JP)

(73) Assignee: Ricoh Company, Limited, Tokyo (JP)

( * ) Notice: Subject to any disclaimer, the term of this patent is extended or adjusted under 35 U.S.C. 154(b) by 9 days.

(21) Appl. No.: 12/805,721

(22) Filed: Aug. 17, 2010

(65) Prior Publication Data

US 2011/0064541 A1 Mar. 17, 2011

(30) Foreign Application Priority Data

Sep. 14, 2009 (JP) ..... 2009-212375

(51) Int. Cl.
*B65H 37/04* (2006.01)

(52) U.S. Cl. ..... 270/45; 270/32; 270/37; 270/51; 270/58.07; 270/58.11

(58) Field of Classification Search ..... 270/32, 270/37, 45, 46, 51, 58.07, 58.11; 412/22, 412/23

See application file for complete search history.

(56) References Cited

U.S. PATENT DOCUMENTS

| | | | | |
|---|---|---|---|---|
| 3,451,082 | A * | 6/1969 | Sarring | 412/5 |
| 7,325,799 | B2 * | 2/2008 | Watkiss | 270/39.08 |
| 7,328,892 | B2 | 2/2008 | Asami et al. | |
| 7,631,860 | B2 | 12/2009 | Asami et al. | |
| 2003/0031532 | A1 * | 2/2003 | Nolte et al. | 412/33 |
| 2004/0126163 | A1 | 7/2004 | Asami et al. | |
| 2007/0182082 | A1 | 8/2007 | Asami et al. | |
| 2008/0284092 | A1 | 11/2008 | Suzuki et al. | |
| 2009/0039593 | A1 | 2/2009 | Kikkawa et al. | |
| 2009/0152789 | A1 | 6/2009 | Kikkawa et al. | |
| 2010/0239393 | A1 * | 9/2010 | Suzuki et al. | 412/33 |
| 2010/0258994 | A1 * | 10/2010 | Kikkawa et al. | 270/37 |
| 2010/0303585 | A1 | 12/2010 | Asami et al. | |
| 2010/0310340 | A1 | 12/2010 | Suzuki et al. | |

FOREIGN PATENT DOCUMENTS

| | | |
|---|---|---|
| JP | 2001-260564 | 9/2001 |
| JP | 2004-168012 | 6/2004 |
| JP | 2007-237562 | 9/2007 |

OTHER PUBLICATIONS

European Search Report dated Jan. 19, 2011 issued in corresponding European Application No. 10251429.6.

* cited by examiner

*Primary Examiner* — Leslie A Nicholson, III
(74) *Attorney, Agent, or Firm* — Harness, Dickey & Pierce, P.L.C.

(57) ABSTRACT

An spine formation device includes a sheet conveyer, a contact member including a first row of grooves provided in a contact surface thereof to house a projection projecting from a folded portion of a bundle of folded sheets, a driving unit to move the contact member, first and second sandwiching units to squeeze the bundle, a discharge unit, and a controller. The first row of grooves extends in parallel to the folded portion of the bundle and includes at least a first pair of grooves inclined in different directions with an interval therebetween varying in size with location of the grooves in a first direction perpendicular to a sheet conveyance direction. The contact member is moved to change the size of interval between the first pair of grooves at a position aligned with the projection projecting from the folded portion of the bundle of folded sheets.

10 Claims, 19 Drawing Sheets

SPINE FORMATION DEVICE, POST-PROCESSING APPARATUS, AND BOOKBINDING SYSTEM

CROSS-REFERENCE TO RELATED APPLICATIONS

This patent specification is based on and claims priority from Japanese Patent Application No. 2009-212375, filed on Sep. 14, 2009 in the Japan Patent Office, the contents of which are hereby incorporated by reference herein in their entirety.

BACKGROUND OF THE INVENTION

1. Field of the Invention

The present invention generally relates to a spine formation device to form a spine of a bundle of folded sheets, a post-processing apparatus including the spine formation device, and a bookbinding system including the spine formation device and an image forming apparatus, such as a copier, a printer, a facsimile machine, or a multifunction machine capable of at least two of these functions.

2. Discussion of the Background Art

Post-processing apparatuses to perform post processing of recording media, such as aligning, sorting, stapling, punching, and folding of sheets, are widely used and are often disposed downstream from an image forming apparatus to perform post-processing of the sheets output from the image forming apparatus. At present, post-processing apparatuses generally perform saddle-stitching along a centerline of sheets in addition to conventional edge-stitching along an edge portion of sheets.

However, when a bundle of sheets (hereinafter "booklet") is saddle-stitched or saddle-stapled and then folded in two, its folded portion, that is, a portion around its spine, tends to bulge, degrading the overall appearance of the booklet. In addition, the bulging spine makes the booklet thicker on the spine side and thinner on the opposite side, making it difficult to stack, store, or transport them. Flattening the spines of the booklets improves their appearance and allows a relatively large number of booklets to be piled together with ease.

It is to be noted that the term "spine" used herein means not only the stitched side of the booklet but also portions of the front cover and the back cover continuous with the spine.

To improve the quality of the finished product, several approaches, described below, for shaping the folded portion of a bundle of saddle-stitched sheets have been proposed.

For example, in JP-2001-260564-A, the spine of the booklet is flattened using a pressing member configured to sandwich an end portion of the booklet adjacent to the spine and a spine-forming roller serving as a spine pressing member configured to roll in a longitudinal direction of the spine while contacting the spine of the booklet. The spine-forming roller moves at least once over the entire length of the spine of the booklet being fixed by the pressing member while applying to the spine a pressure sufficient to flatten the spine.

Although this approach can flatten the spine of the booklet to a certain extent, it is possible that the sheets might wrinkle and be torn around the spine or folded portion because the pressure roller applies localized pressure to the spine continuously. Further, it takes longer to flatten the spine because the pressure roller must move over the entire length of the spine of the booklet.

Moreover, this approach does not consider stapled booklets. More specifically, when staples project from the surface of the spine of the booklet, the spine pressing member simply presses the staples upstream in the direction in which the booklet is transported, thus making the surface of the spine uneven and degrading the appearance of the booklet.

To address the above-described problem, for example, JP-2007-237562-A proposes a spine formation device that includes a sandwiching member that sandwiches the booklet from the front side and the back side of the booklet, a pressure member disposed downstream from the sandwiching member in a direction in which the bundle of folded sheets is transported, and a spine pressing member (i.e., a spine pressing plate) that is pressed against the spine of the booklet. After the spine pressing plate is pressed against the spine of the booklet, the pressure member squeezes the spine from the side, that is, in the direction of the thickness of the booklet to reduce bulging of the spine.

This configuration can reduce the pressure exerted on the spine and accordingly reduce damage to the spine compared with the first method described above, in which the spine formation member applies relatively high pressure to the spine while moving along the spine.

Additionally, in the second method, recessed portions are formed in the surface of the spine pressing plate pressing against the spine to accommodate objects such as loop stitches projecting from the spine of the booklet.

However, although aiming at eliminating adverse effects caused by the objects projecting from the spine in spine formation, the second method is not very flexible in application. For example, this configuration cannot accommodate changes in the size of interval between staples or changes in the number of staples used in the booklet.

In view of the foregoing, the inventors of the present invention recognize that there is a need for an apparatus capable of flattening the spine of the booklet regardless of the position or the number of staples in used in the booklet.

SUMMARY OF THE INVENTION

In view of the foregoing, an object of the present specification is to improve flatness of the spine of the booklet regardless of the position or the number of staples used in the booklet.

In one illustrative embodiment of the present invention, a spine formation device includes a sheet conveyer that conveys a bundle of folded sheets in a sheet conveyance direction with a folded portion of the bundle of folded sheets forming a front end portion of the bundle of folded sheets, a contact member disposed downstream from the sheet conveyer in the sheet conveyance direction, a driving unit to move the contact member relative to the folded portion of the bundle of folded sheets, in a first direction perpendicular to the sheet conveyance direction, first and second sandwiching units disposed downstream from the sheet conveyer in the sheet conveyance direction, a discharge unit to discharge the bundle of folded sheets to a discharge tray, and a controller operatively connected to the sheet conveyer, to the first and second sandwiching units, and to the driving unit. The contact member includes a contact surface extending in the first direction, against which the folded portion of the bundle of folded sheets is pressed, and a first row of grooves is provided in the contact surface to house a projection projecting from the folded portion of the bundle of folded sheets. The first row of grooves extends in a second direction parallel to the folded portion of the bundle of folded sheets and includes at least a first pair of grooves inclined in different directions with an interval therebetween varying in size with location of the grooves in the first direction. The controller causes the driving unit to move the contact member to change the size of interval between the first pair of grooves at a position in the first direction, aligned with the projection projecting from the folded portion of the bundle of folded sheets. With the folded portion pressed against the contact member, the first sandwiching unit squeezes the bundle of folded sheets in a direction of thickness of the bundle of folded sheets. Then, the second sandwiching unit disposed downstream from the first sandwiching unit in the sheet conveyance direction forms a spine of the bundle of folded sheets by squeezing a bulging of the bundle of folded sheets created between the first sandwiching unit and the contact member.

Another illustrative embodiment of the present invention provides a post-processing apparatus to perform post processing of sheets transported from an image forming apparatus. The post-processing apparatus includes a saddle-stapler to staple a bundle of sheets together along a centerline of the bundle, a folding unit to fold the bundle of sheets along the centerline of the bundle, and the spine formation device described above.

Yet in another illustrative embodiment of the present embodiment, a bookbinding system includes an image forming apparatus and the post-processing apparatus described above.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION OF PREFERRED EMBODIMENTS

Figure 1:
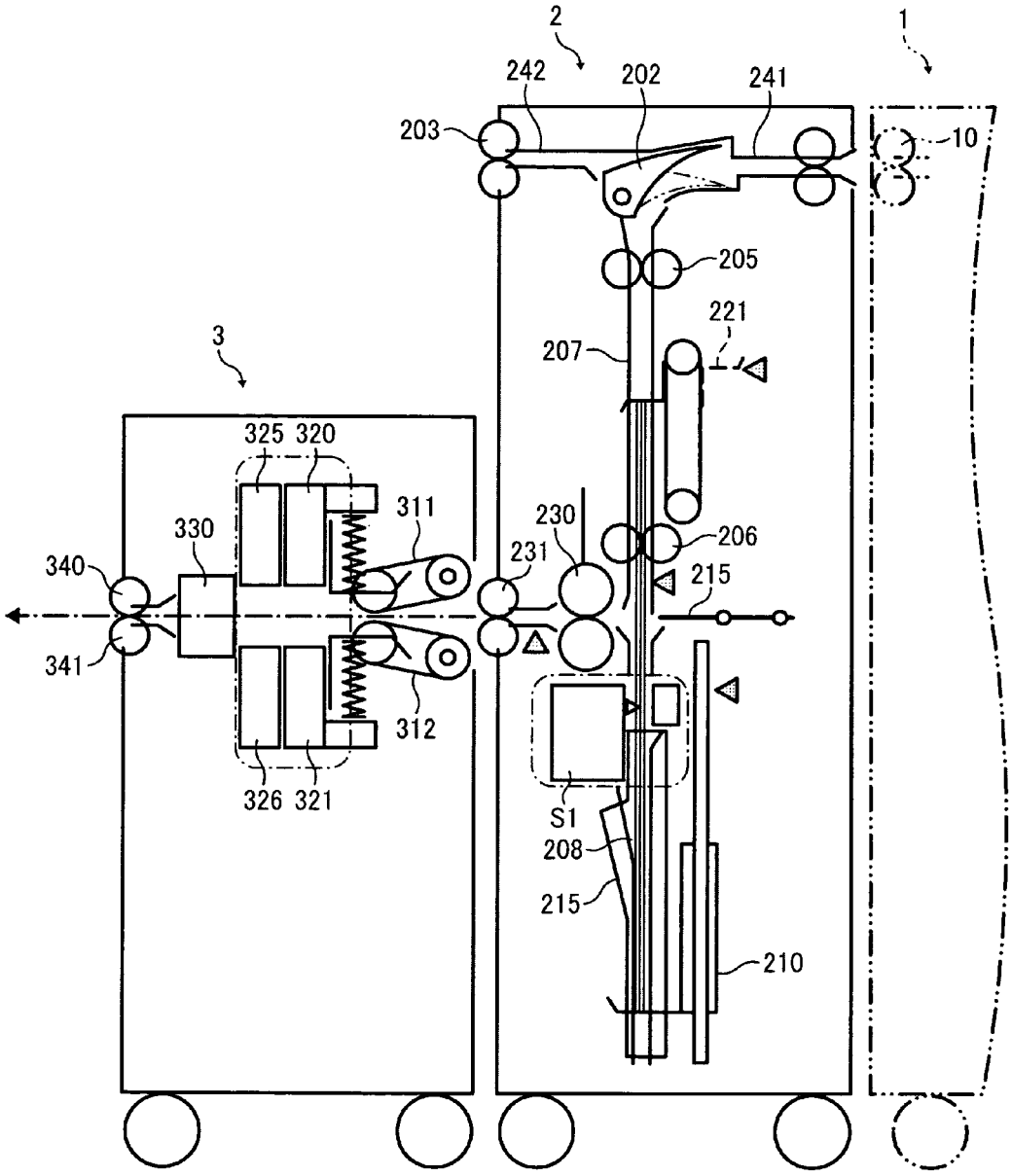
FIG. 1 illustrates a bookbinding system including an image forming apparatus, a post-processing apparatus and a spine formation device according to an illustrative embodiment of the present invention.

In describing preferred embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

Referring now to the drawings, wherein like reference numerals designate identical or corresponding parts throughout the several views thereof, and particularly to FIG. 1, a bookbinding system according to an illustrative embodiment of the present invention is described.

It is to be noted that, in the description below, a pair of transport belts 311 and 312 of a transport unit 31 serves as a sheet conveyer, a contact plate 330 serves as a contact member, a pair of auxiliary sandwiching plates 320 and 321 serves as a first sandwiching unit, a pair of sandwiching plates 325 and 326 serves as a second sandwiching unit, and a central processing unit (CPU) 3-1 serves as a controller. Further, a discharge guide plate 335 and a pair of discharge rollers 340 and 341 together form a discharge unit.

FIG. 1 illustrates a bookbinding system including an image forming apparatus 100 (shown in FIG. 18), a post-processing apparatus 1, a bookbinding device 2, and a spine formation device 3 according to an illustrative embodiment of the present invention.

In FIG. 1, the post-processing apparatus 1 is connected to a downstream side of the image forming apparatus 100, and the bookbinding device 2 is connected to a downstream side of the post-processing apparatus 1 in a direction in which a bundle of sheets is transported (hereinafter "sheet conveyance direction"). Further, the spine formation device 3 is connected to a downstream side of the bookbinding device 2 in the sheet conveyance direction. In this system, the bookbinding device 2 performs saddle-stitching or saddle-stapling, that is, stitches or staples, along its centerline, a bundle of sheets discharged thereto by a pair of discharge rollers 10 from the post-processing apparatus 1 and then folds the bundle of sheets along the centerline, after which a pair of discharge rollers 231 transports the bundle of folded sheets (hereinafter also "booklet") to the spine formation device 3. Then, the spine formation device 3 flattens the folded portion of the booklet and discharges it outside the spine formation device 3. The image forming apparatus 100 may be a copier, a printer, a facsimile machine, or a multifunction peripheral (MFP) including at least two of those functions that forms images on sheets of recording media based on image data input by users or read by an image reading unit. The image forming apparatus 100 is hereinafter also referred to as the MFP 100.

The spine formation device 3 includes transport belts 311 and 312, auxiliary sandwiching plates 320 and 321, sandwiching plates 325 and 326, a contact plate 330, and a pair of discharge rollers 340 and 341 disposed in that order in the sheet conveyance direction.

Figure 2:
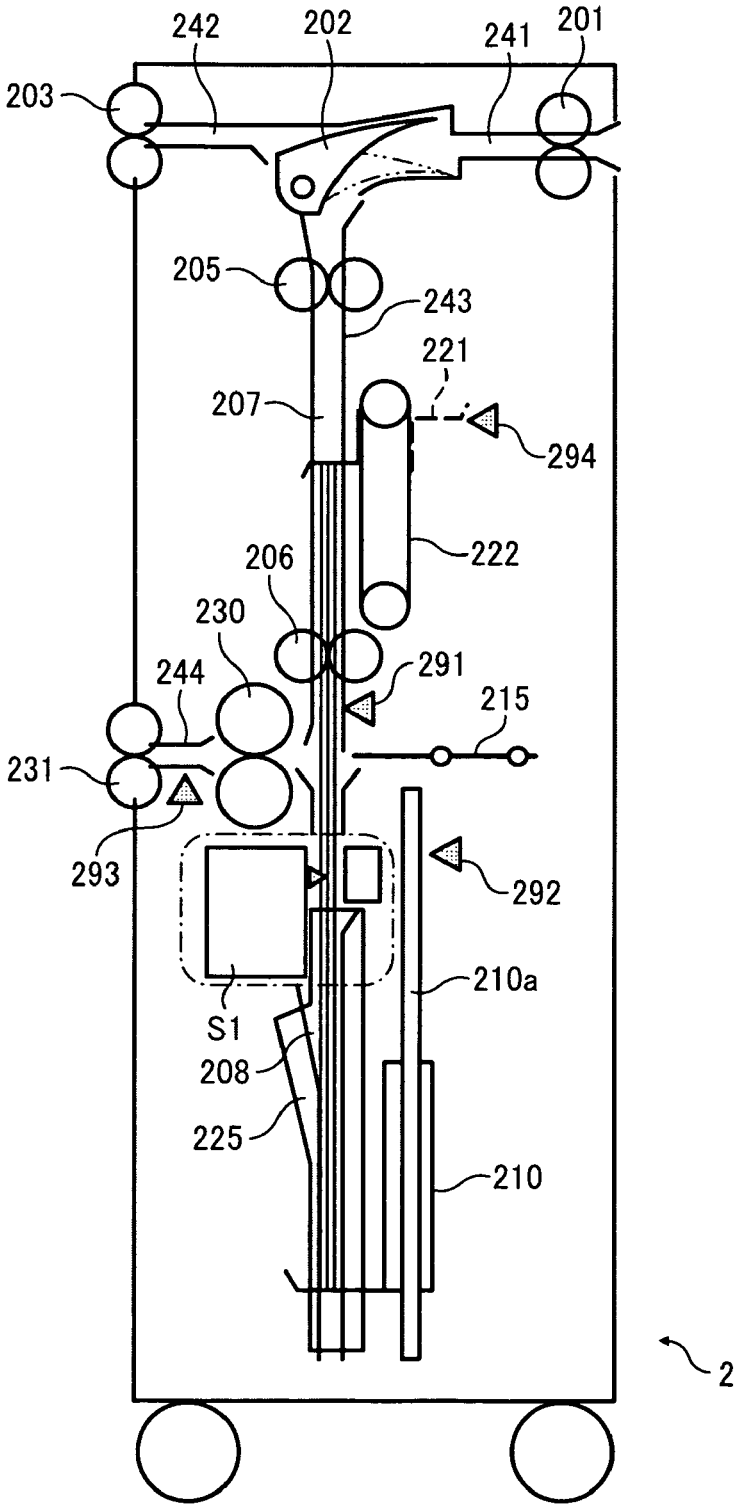
FIG. 2 is a front view illustrating a configuration of the post-processing apparatus shown in FIG. 1.

Referring to FIGS. 1 and 2, a configuration of the bookbinding device 2 is described below.

FIG. 2 illustrates a configuration of the bookbinding device 2.

Referring to FIG. 2, an entrance path 241, a sheet path 242, and a center-folding path 243 are formed in the bookbinding device 2. A pair of entrance rollers 201 provided extreme upstream in the entrance path 241 in the sheet conveyance direction receives a bundle of aligned sheets transported by the discharge rollers 10 of the post-processing apparatus 1. It is to be noted that hereinafter "upstream" and "downstream" refer to those in the sheet conveyance direction unless otherwise specified.

A separation pawl 202 is provided downstream from the entrance rollers 201 in the entrance path 241. The separation pawl 202 extends horizontally in FIG. 2 and switches the sheet conveyance direction between a direction toward the sheet path 242 and that toward the center-folding path 243. The sheet path 242 extends horizontally from the entrance path 241 and guides the bundle of sheets to a downstream device or a discharge tray, not shown, and a pair of upper discharge rollers 203 discharges the bundle of sheets from the sheet path 242. The center-folding path 243 extends vertically in FIGS. 1 and 2 from the separation pawl 202, and the bundle of sheets is transported along the center-folding path 243 when at least one of stapling and folding is performed.

Along the center-folding path 243, an upper sheet guide 207 and a lower sheet guide 208 to guide the bundle of sheets are provided above and beneath a folding plate 215, respectively, and the folding plate 215 is used to fold the bundle of sheets along its centerline. A pair of upper transport rollers 205, a trailing-edge alignment pawl 221, and a pair of lower transport rollers 206 are provided along the upper sheet guide 207 in that order from the top in FIG. 2. The trailing-edge alignment pawl 221 is attached to a pawl driving belt 222 driven by a driving motor, not shown, and extends perpendicularly to a surface of the driving belt 222. As the pawl driving belt 222 rotates opposite directions alternately, the trailing-edge alignment pawl 221 pushes a trailing-edge of the bundle of sheets toward a movable fence 210 disposed in a lower portion in FIG. 2, thus aligning the bundle of sheets. Additionally, the trailing-edge alignment pawl 221 moves away from the upper sheet guide 207 to a position indicated by broken lines shown in FIG. 2 when the bundle of sheets enters the center-folding path 243 and ascends to a folding position from the alignment position. In FIG. 2, reference numeral 294 represents a pawl home position (HP) detector that detects the trailing-edge alignment pawl 221 at a home position indicated by the broken lines shown in FIG. 2. The trailing-edge alignment pawl 221 is controlled with reference to the home position.

A saddle stapler S1, a pair of jogger fences 225, and the movable fence 210 are provided along the lower sheet guide 208 in that order from the top in FIG. 2. The lower sheet guide 208 receives the bundle of sheets guided by the upper sheet guide 207, and the pair of jogger fences 225 extends in a sheet width direction perpendicular to the sheet conveyance direction. The movable fence 210 positioned beneath the lower sheet guide 208 moves vertically, and a leading edge of the bundle of sheets contacts the movable fence 210.

The saddle stapler S1 staples the bundle of sheets along its centerline. While supporting the leading edge of the bundle of sheets, the movable fence 210 moves vertically, thus positioning a center portion of the bundle of sheets at a position facing the saddle stapler S1, where saddle stapling is performed. The movable fence 210 is supported by a fence driving mechanism 210*a* and can move from the position of a fence HP detector 292 disposed above the stapler S1 to a bottom position in the bookbinding device 2 in FIG. 2. A movable range of the movable fence 210 that contacts the leading edge of the bundle of sheets is set so that strokes of the movable fence 210 can align sheets of any size processed by the bookbinding device 2. It is to be noted that, for example, a rack-and-pinion may be used as the fence driving mechanism 210*a*.

The folding plate 215, a pair of folding rollers 230, and a discharge path 244, and the pair of lower discharge rollers 231 are provided horizontally between the upper sheet guide 207 and the lower sheet guide 208, that is, in a center portion of the center-folding path 243 in FIG. 2. The folding plate 215 can move reciprocally back and forth horizontally in FIG. 2 in the folding operation, and the folding plate 215 is aligned with a position where the folding rollers 230 press against each other (hereinafter "nip") in that direction. The discharge path 244 is positioned also on an extension line from the line connecting them. The lower discharge rollers 231 are disposed extreme downstream in the discharge path 244 and discharge the bundle of folded sheets to a subsequent stage.

Additionally, a sheet detector 291 provided on a lower side of the upper sheet guide 207 in FIG. 2 detects the leading edge of the bundle of sheets that passes a position facing the folding plate 215*a* (hereinafter "folding position") in the center-folding path 243. Further, a folded portion detector 293 provided along the discharge path 224 detects the folded leading-edge portion (hereinafter simply "folded portion") of the bundle of folded sheets, thereby recognizing the passage of the bundle of folded sheets.

Saddle-stapling and center-holding performed by the bookbinding device 2 shown in FIG. 2 are described briefly below with reference to FIGS. 3 through 7.

When a user selects saddle-stapling and center-folding via an operation panel 105 (shown in FIG. 18) of the image forming apparatus 100, the separation pawl 202 pivots counterclockwise in FIG. 2, thereby guiding the bundle of sheets to be stapled and folded to the center-folding path 243. The separation pawl 201 is driven by a solenoid, not shown. Alternatively, the separation pawl 201 may be driven by a motor.

Figure 3:
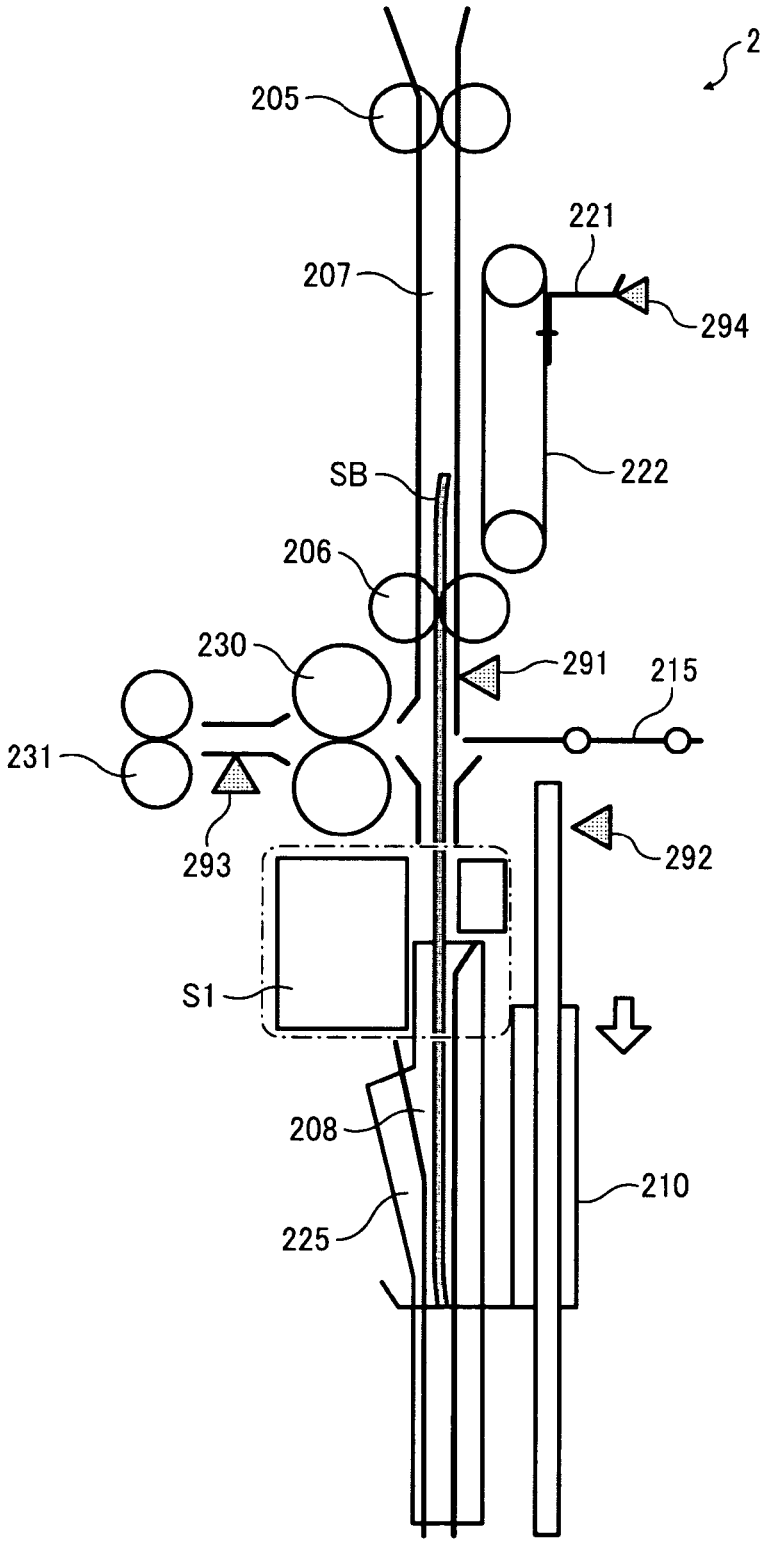
FIG. 3 illustrates the post-processing apparatus in which a bundle of sheets is transported.

A bundle of sheets SB transported to the center-folding path 243 is transported by the upper transport rollers 205 downward in the center-folding path 243 in FIG. 3. After the sheet detector 291 detects the passage of the bundle of sheet SB, the lower transport rollers 206 transport the bundle of sheets SB until the leading edge of the bundle of sheets SB contacts the movable fence 210 as shown in FIG. 3. At that time, the movable fence 210 is at a standby position that is varied in the vertical direction shown in FIG. 3 according to sheet size data, that is, sheet size data in the sheet conveyance direction, transmitted from the image forming apparatus 100 shown in FIG. 18. Simultaneously, the lower transport rollers 206 sandwich the bundle of sheets SB therebetween, and the trailing-edge alignment pawl 221 is at the home position.

Figure 4:
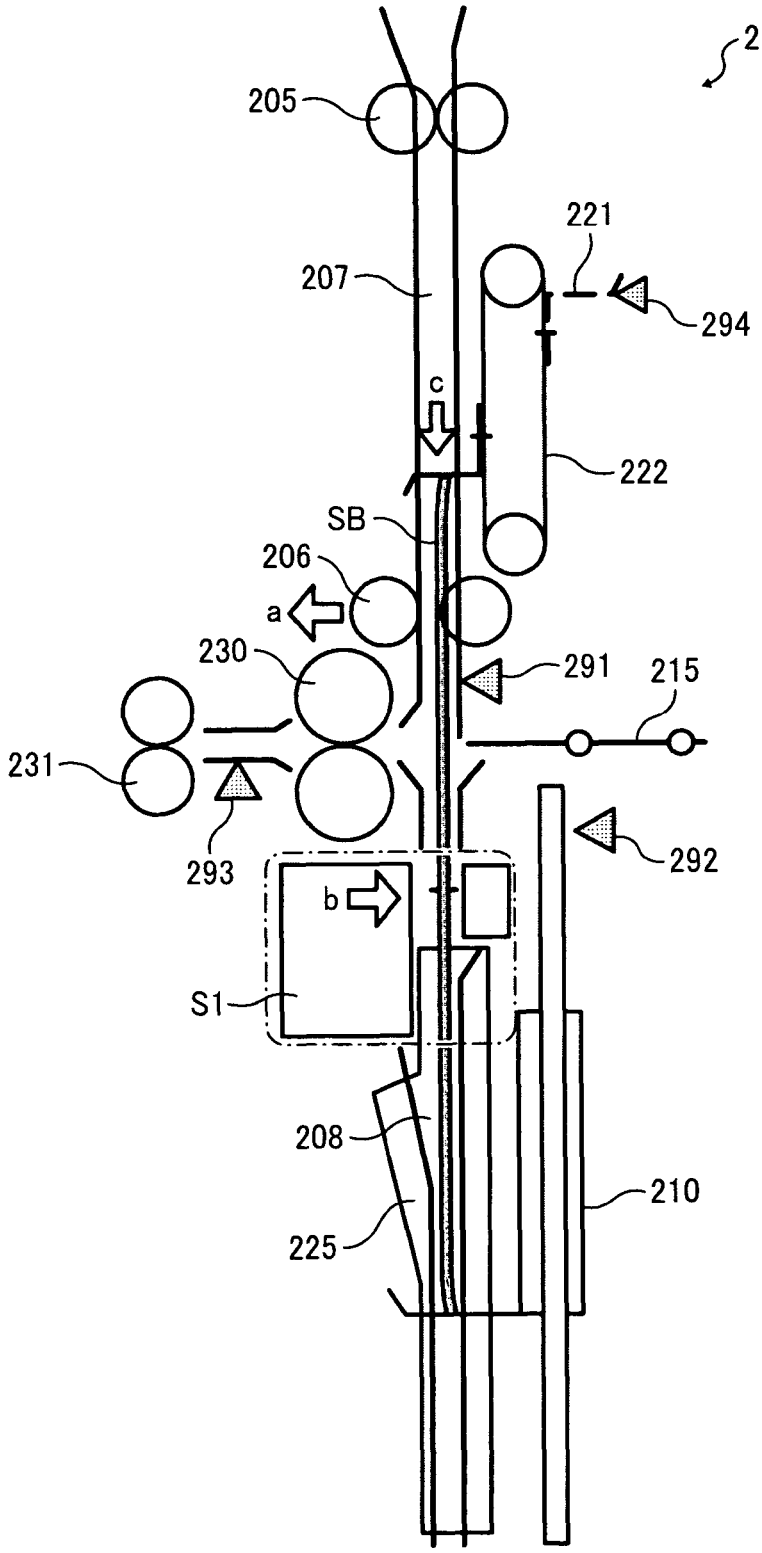
FIG. 4 illustrates the post-processing apparatus in which the bundle of sheets is stapled along the centerline.

When the pair of lower transport rollers 206 is moved away from each other as indicated by arrow a shown in FIG. 4, releasing the trailing edge of the bundle of sheets SB whose leading edge is in contact with the movable fence 210, the trailing-edge alignment pawl 221 is driven to push the trailing edge of the bundle of sheets SB, thus aligning the bundle of sheets SB in the sheet conveyance direction as indicated by arrow c shown in FIG. 4.

Subsequently, the bundle of sheets SB is aligned in the sheet width direction perpendicular to the sheet conveyance direction by the pair of jogger fences 225, and thus alignment of the bundle of sheets SB in both the sheet width direction and the sheet conveyance direction is completed. At that time, the amounts by which the trailing-edge alignment pawl 221 and the pair of jogger fences 225 push the bundle of sheets SB to align it are set to optimum values according to the sheet size, the number of sheets, and the thickness of the bundle.

It is to be noted that, when the bundle of sheets SB is relatively thick, the bundle of sheets SB occupies a larger area in the center-folding path 243 with the remaining space therein reduced, and accordingly a single alignment operation is often insufficient to align it. Therefore, the number of alignment operations is increased in that case. Thus, the bundle of sheets SB can be aligned fully. Additionally, as the number of sheets increases, it takes longer to stack multiple sheets one on another upstream from the bookbinding device 2, and accordingly it takes longer before the bookbinding device 2 receives a subsequent bundle of sheets. Consequently, the increase in the number of alignment operations does not cause a loss time in the sheet processing system, and thus efficient and reliable alignment can be attained. Therefore, the number of alignment operations may be adjusted according to the time required for the upstream processing.

It is to be noted that the standby position of the movable fence 210 is typically positioned facing the saddle-stapling position of the bundle of sheets SB or the stapling position of the saddle stapler S1. When aligned at that position, the bundle of sheets SB can be stapled at that position without moving the movable fence 210 to the saddle-stapling position of bundle of sheets SB. Therefore, at that standby position, a stitcher, not shown, of the saddle stapler S1 is driven in a direction indicated by arrow b shown in FIG. 4, and thus the bundle of sheets SB is stapled between the stitcher and a clincher, not shown, of the saddle stapler S1.

It is to be noted that the positions of the movable fence 210 and the trailing-edge alignment pawl 221 are controlled with pulses of the fence HP detector 292 and the pawl HP detector 294, respectively. Positioning of the movable fence 210 and the trailing-edge alignment pawl 221 is performed by a central processing unit (CPU) 2-1 of a control circuit, shown in FIG. 18, of the bookbinding device 2.

Figure 5:
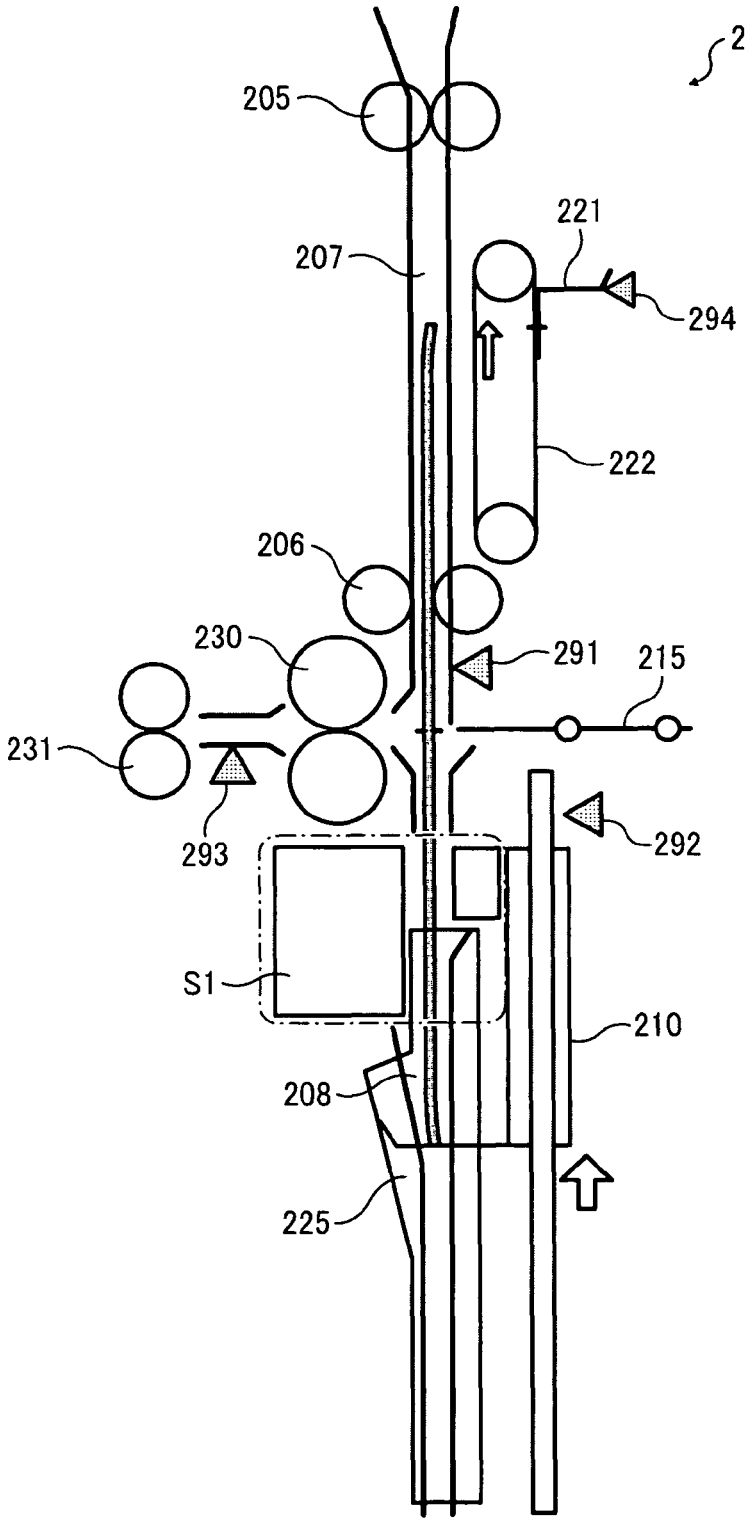
FIG. 5 illustrates the post-processing apparatus in which the bundle of sheets is set at a center-folding position.

After stapled along the centerline in the state shown in FIG. 4, the bundle of sheets SB is lifted to a position where the saddle-stapling position thereof faces the folding plate 215 as the movable fence 210 moves upward as shown in FIG. 5 while the pair of lower transport rollers 206 does not press against the bundle of sheets SB. This position is adjusted with reference to the position detected by the fence HP detector 292.

Figure 6:
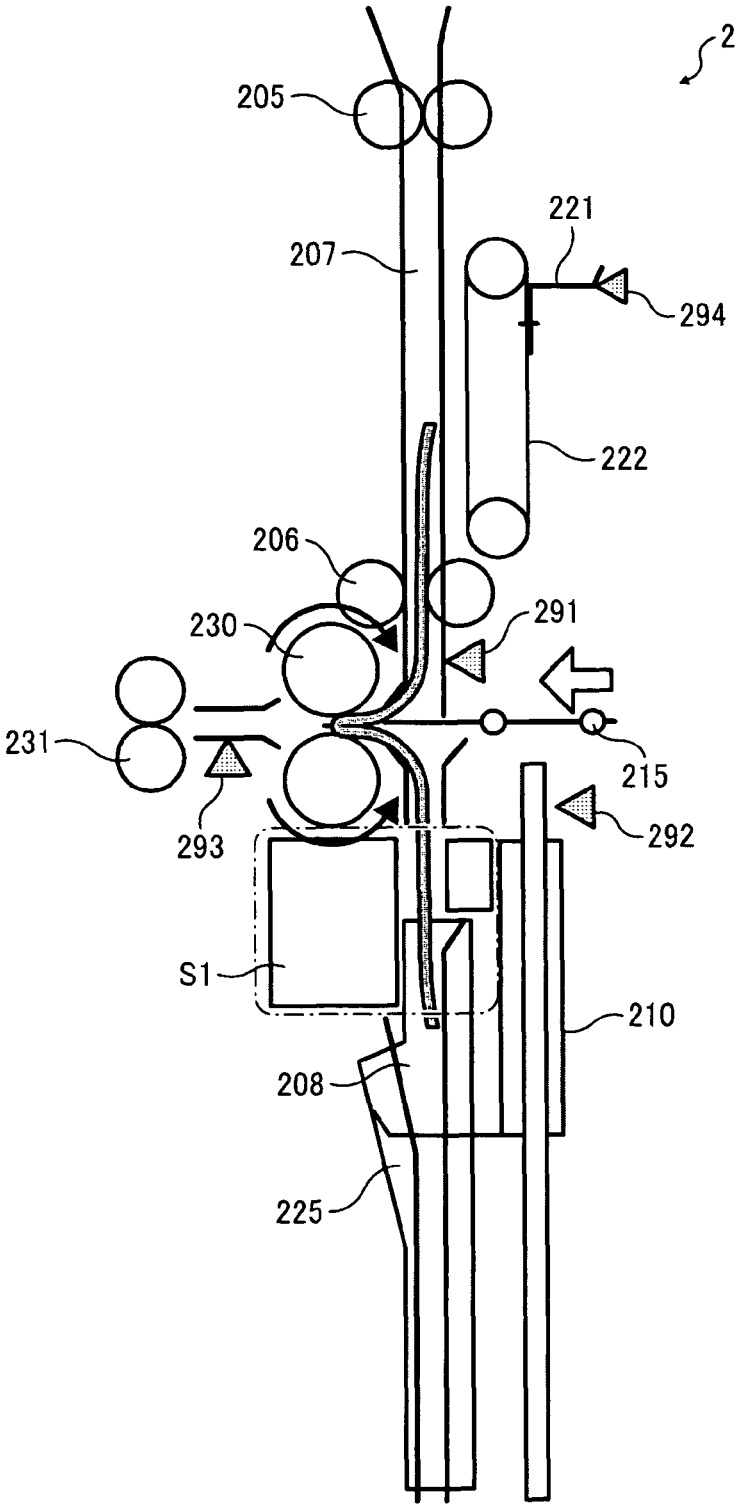
FIG. 6 illustrates the post-processing apparatus in which the bundle of sheets is being folded in two.
Figure 7:
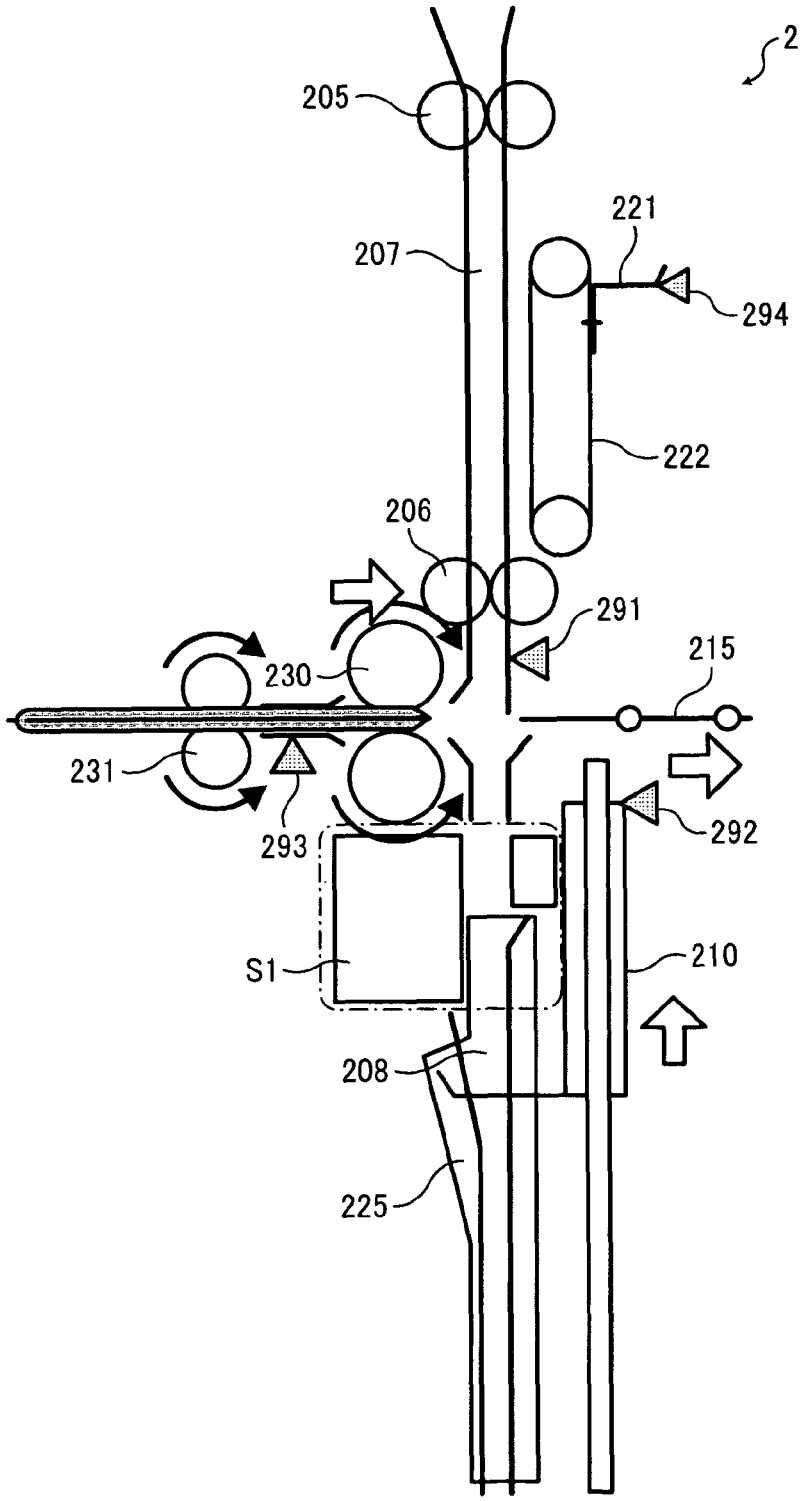
FIG. 7 illustrates the post-processing apparatus from which the bundle of folded sheets is discharged.

FIG. 6 illustrates a state in which a folded leading edge of the booklet SB is squeezed in the nip between the folding rollers 230.

After the bundle of sheets SB is set at the position shown in FIG. 5, the folding plate 215 approaches the nip between the pair of folding rollers 230 as shown in FIG. 6 and pushes toward the nip the bundle of sheets SB in a portion around the staples binding the bundle in a direction perpendicular or substantially perpendicular to a surface of the bundle of sheets SB. Thus, the bundle of sheets SB pushed by the folding plate 215 is folded in two and sandwiched between the pair of folding roller 230 being rotating. While squeezing the bundle of sheets SB caught in the nip, the pair of folding roller 230 transports the bundle of sheets SB. Thus, while squeezed and transported by the folding rollers 230, the bundle of sheets SB is center-folded as a booklet SB.

After folded in two as shown in FIG. 6, the booklet SB is transported by the folding rollers 230 downstream and then discharged by the discharged rollers 231 to a subsequent stage. When the folded portion detector 293 detects a trailing edge portion of the booklet SB, both the folding plate 215 and the movable fence 210 return to the respective home positions. Then, the lower transport rollers 206 move to press against each other as a preparation for receiving a subsequent bundle of sheets. Further, if the number and the size of sheets forming the subsequent bundle are similar to those of the previous bundle of sheets, the movable fence 210 can wait again at the position shown in FIG. 3. The above-described control is performed also by the CPU 2-1 of the bookbinding device 2.

Figure 8:
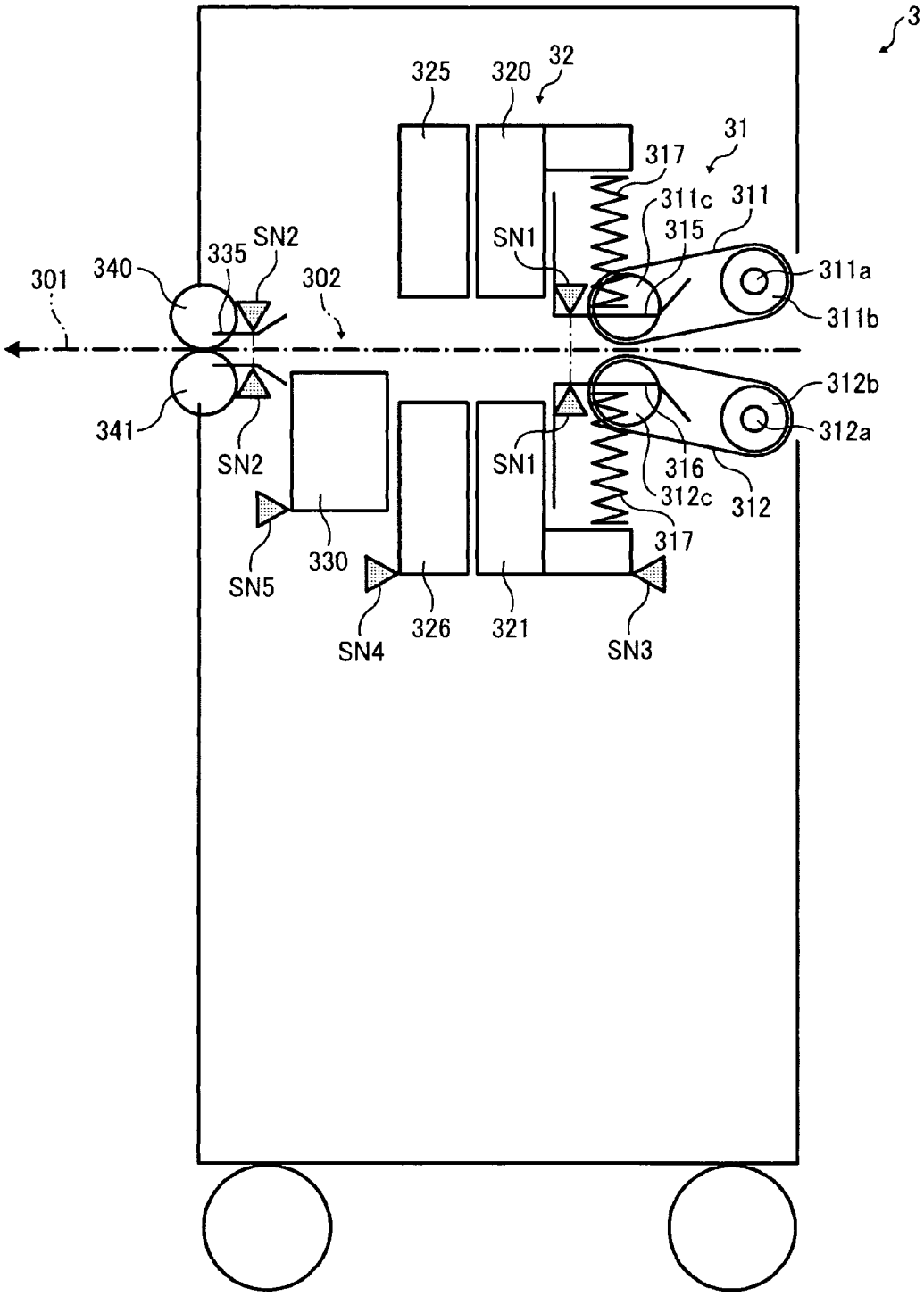
FIG. 8 is a front view illustrating a configuration of the spine formation devices shown in FIG. 1.

FIG. 8 is a front view illustrating a configuration of the spine formation device 3 shown in FIG. 1.

Referring to FIG. 8, the spine formation device 3 includes the conveyance unit 31 serving as the sheet conveyer, an auxiliary sandwiching unit 32 serving as the first sandwiching unit, the vertically-arranged sandwiching plates 325 and 326 serving as the second sandwiching unit, the contact plate 330 serving as the contact member, and a discharge unit.

The conveyance unit 31 includes the vertically-arranged transport belts 311 and 312, the auxiliary sandwiching unit 32 includes the vertically-arranged guide plates 315 and 316 and the vertically-arranged auxiliary sandwiching plates 320 and 321, and the discharge unit includes the discharge guide plate 335 and the pair of discharge rollers 340 and 341 in FIG. 8. It is to be note that the lengths of the respective components are greater than the width of the bundle of sheets SB in a direction perpendicular to the surface of paper on which FIG. 8 is drawn.

The upper transport belt 311 and the lower transport belt 312 are respectively stretched around driving pulleys 311*b* and 312*b* supported by swing shafts 311*a* and 312*a* and driven pulleys 311*c* and 312*c* disposed downstream from the driving pulleys 311*b* and 312*b*. A driving motor, not shown, drives the transport belts 311 and 312. The transport belts 311 and 312 are disposed on both sides of (in FIG. 8, above and beneath) a transport centerline 301 of a transport path 302, aligned the line extended from the line connecting the folding plate 215, the nip between the folding rollers 230, and the nip between the discharge rollers 231. The swing shafts 311*a* and 312*a* respectively support the transport belts 311 and 312 swingably so that the gap between the driven pulleys 311*c* and 312*c* is adjusted corresponding to the thickness of the bundle of sheets. The upper guide plate 315 and the lower guide plate 316 are respectively attached to the upper auxiliary sandwiching plate 320 and the lower auxiliary sandwiching plate 321 with pressure springs 317.

It is to be noted that, in FIG. 8, reference characters SN1 through SN5 respectively represent a sheet detector, a discharge detector, an auxiliary sandwiching plate HP detector, a sandwiching plate HP detector, and a contact plate HP detector. Further, in the configuration shown in FIG. 8, the transport centerline 301 means a center of the transport path 302 in the vertical direction.

Figure 9A:
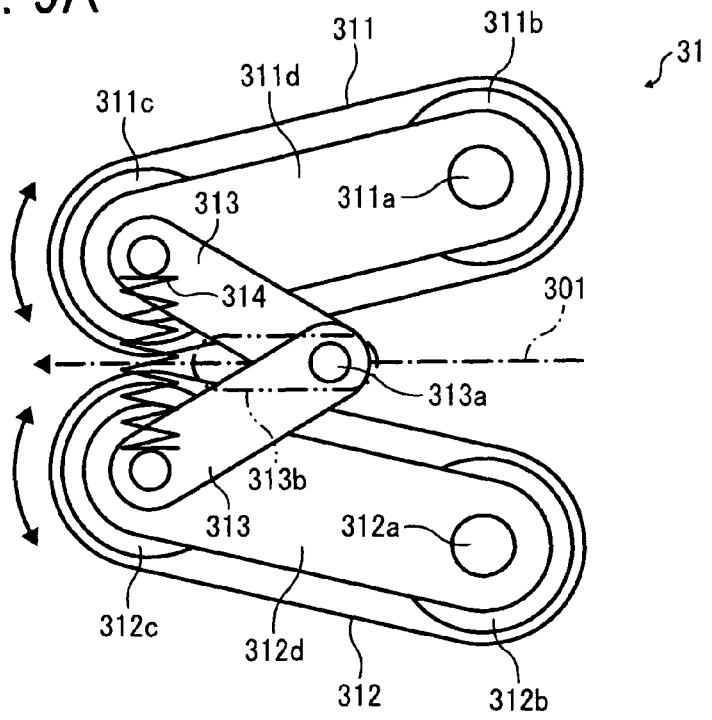
FIG. 9A illustrates an initial state of a transport unit of the spine formation device shown in FIG. 8 to transport a bundle of folded sheets.
Figure 9B:
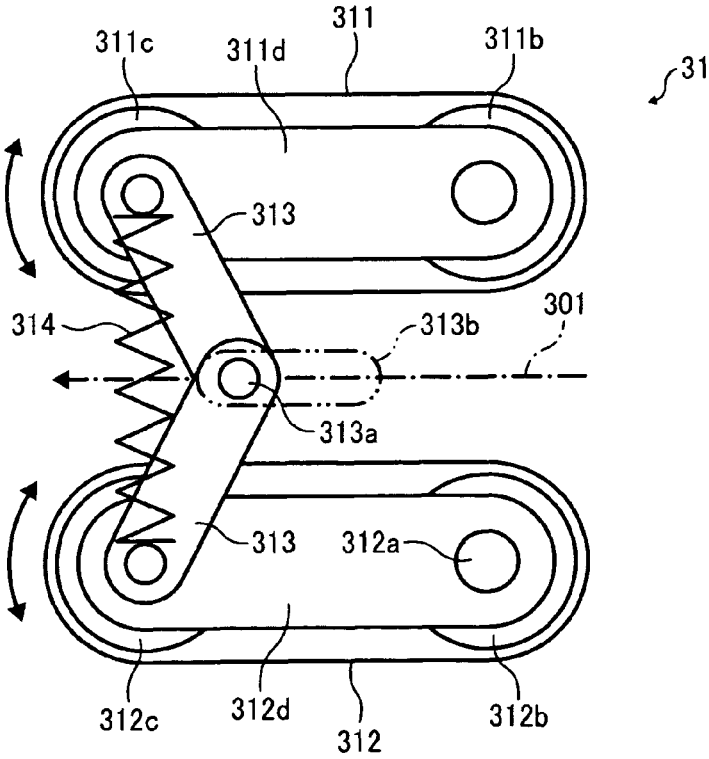
FIG. 9B illustrates a state of the transport unit shown in FIG. 9A in which the bundle of folded sheets is transported.

The conveyance unit 31 to transport the bundle of sheets SB using the vertically-arranged transport belts 311 and 312 is described in further detail below with reference to FIGS. 9A and 9B. FIGS. 9A and 9B illustrate an initial state of the spine formation device 3 and a state in which the bundle of sheets SB is transported therein, respectively.

As shown in FIGS. 9A and 9B, the driving pulleys 311*b* and 312*b* are connected to the driven pulleys 311*c* and 312*c* with support plates 311*d* and 312*d*, respectively, and the transport belts 311 and 312 are respectively stretched around the driving pulleys 311*b* and 312*b* and the driven pulleys 311*c* and 312*c*. With this configuration, the transport belts 311 and 312 are driven by the driving pulleys 311*b* and 312*b*, respectively.

By contrast, rotary shafts of the driven pulleys 311*c* and 312*c* are connected by a link 313 formed with two members connected movably with a connection shaft 313*a*, and a pressure spring 314 biases the driven pulleys 311*c* and 312*c* to approach each other. The connection shaft 313*a* engages a slot 313*b* extending in the sheet conveyance direction, formed in a housing of the spine formation device 3 and can move along the slot 313*b*. With this configuration, as the two members forming the link 313 attached to the driven pulleys 311*c* and 312*c* move, the connection shaft 313*a* moves along the slot 313*b*, thus changing the distance between the driven pulleys 311*c* and 312*c* corresponding to the thickness of the booklet SB while maintaining a predetermined or given pressure in a nip where the transport belts 311 and 312 press against each other.

Additionally, a rack-and-pinion mechanism can be used to move the connection shaft 313*a* along the slot 313*b*, and the position of the connection shaft 313*a* can be set by controlling a motor driving the pinion. With this configuration, when the booklet SB is relatively thick, the distance between the driven pulleys 311*c* and 312*c* (hereinafter "transport gap") can be increased to receive the booklet SB, thus reducing the pressure applied to the folded portion (folded leading-edge portion) of the booklet SB by the transport belts 311 and 312 on the side of the driven pulleys 311*c* and 312*c*. It is to be noted that, when power supply to the driving motor is stopped after the folded portion of the booklet SB is sandwiched between the transport belts 311 and 312, the driven pulleys 311*c* and 312*c* can transport the booklet SB sandwiched therebetween with only the elastic bias force of the pressure spring 314.

Figure 10A:
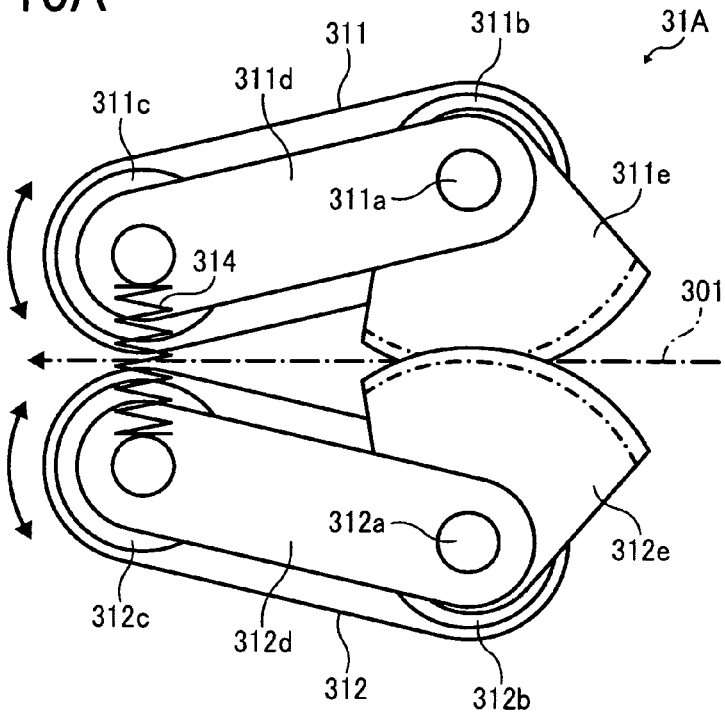
FIGS. 10A and 10B are diagrams of another configuration of the transport unit illustrating an initial state and a state in which the bundle of folded sheets is transported, respectively.
Figure 10B:
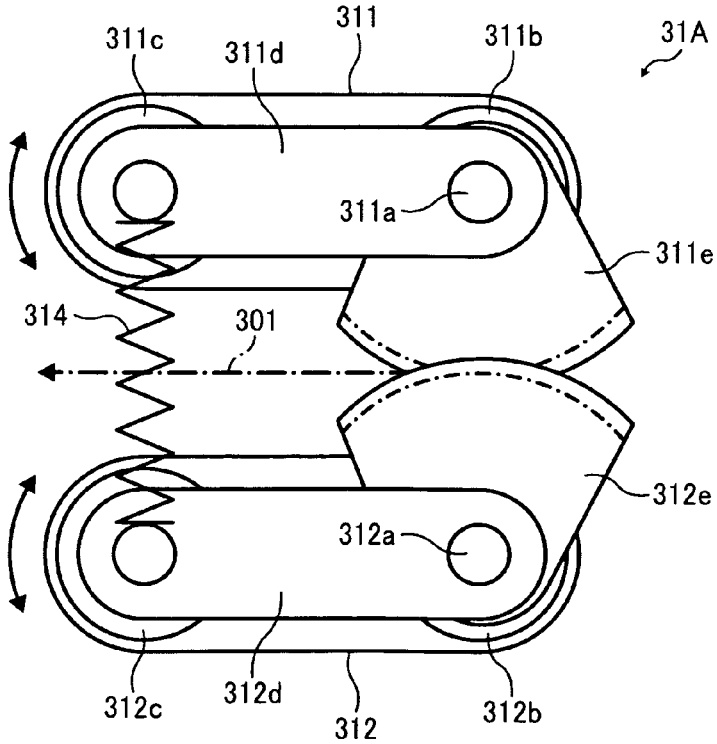

A conveyance unit 31A as another configuration of the conveyance unit is described below with reference to FIGS. 10A and 10B. FIGS. 10A and 10B illustrate an initial state of the conveyance unit 31A and a state in which the bundle of sheets SB is transported therein, respectively.

In the conveyance unit 31A, the swing shafts 311*a* and 312*a* engage sector gears 311*e* and 312*e* instead of using the link 313, respectively, and the sector gears 311*e* and 312*e* engaging each other cause the driven pulleys 311*c* and 312*c* to move vertically away from the transport centerline 301 symmetrically. Also in this configuration, the size of the transport gap to receive the booklet SB can be adjusted by driving one of the sector gears 311*e* and 312*e* with a driving motor including a decelerator similarly to the configuration shown in FIGS. 9A and 9B.

As shown in FIG. 8, the guide plates 315 and 316 are disposed adjacent to the driven pulleys 311*c* and 312*c*, respectively, and arranged symmetrically on both sides of the transport centerline 301, that is, above and beneath the transport centerline 301 in FIG. 8. The guide plates 315 and 316 respectively include flat surfaces in parallel to the transport path 302, extending from the transport nip to a position adjacent to the auxiliary sandwiching plates 320 and 321, and the flat surfaces serve as transport surfaces. The upper guide plate 315 and the lower guide plate 316 are attached to the upper auxiliary sandwiching plate 320 and the lower auxiliary sandwiching plate 321 with pressure springs 317, respectively. The upper guide plate 315 and the lower guide plate 316 are biased to the transport centerline 301 elastically by the respective pressure springs 317 and can move vertically. Further, the auxiliary sandwiching plates 320 and 321 are held by a housing of the spine formation device 3 movably in the vertical direction in FIG. 8. It is to be noted that, alternatively, the guide plates 315 and 316 may be omitted, and the booklet SB may be guided by only surfaces of the auxiliary sandwiching plates 320 and 321 facing the booklet SB, parallel to the transport path 302.

The vertically-arranged auxiliary sandwiching plates 320 and 321 of the auxiliary sandwiching unit 32 approach and move away from each other symmetrically relative to the transport centerline 301 similarly to the transport belts 311 and 312. A driving mechanism, not shown, provided in the auxiliary sandwiching unit 32 to cause this movement can use the link mechanism used in the conveyance unit 31 or the connection mechanism using the rack and the sector gear shown FIGS. 10A and 10B. A reference position used in detecting a displacement of the auxiliary sandwiching plates 320 and 321 can be set with the output from the auxiliary sandwiching plate HP detector SN3. Because the vertically-arranged auxiliary sandwiching plates 320 and 321 and the driving unit, not shown, are connected with a spring similar to the pressure spring 314 in the transport unit 31, or the like, when the booklet SB is sandwiched by the auxiliary sandwiching plates 320 and 321, damage to the driving mechanism caused by overload can be prevented. The surfaces of the auxiliary sandwiching plates 320 and 321 (e.g., pressure sandwiching surfaces) that sandwich the booklet SB are flat surfaces in parallel to the transport centerline 301.

The vertically-arranged sandwiching plates 325 and 326, serving as the sandwiching unit, approach and move away from each other symmetrically relative to the transport centerline 301 similarly to the transport belts 311 and 312. A driving mechanism to cause the sandwiching plates 325 and 326 this movement can use the link mechanism used in the transport unit 31 or the connection mechanism using the rack and the sector gear shown FIGS. 10A and 10B. A reference position used in detecting a displacement of the sandwiching plates 325 and 326 can be set with the output from the sandwiching plate HP detector SN4. Other than the description above, the sandwiching plates 325 and 326 have configurations similar the auxiliary sandwiching plates 320 and 321 and operate similarly thereto, and thus descriptions thereof are omitted. It is to be noted that a driving source such as a driving motor is requisite in the auxiliary sandwiching unit 32 and the sandwiching unit although it is not requisite in the transport unit 31, and the driving source enables the movement between a position to sandwich the booklet and a standby position away form the booklet. The surfaces of the auxiliary sandwiching plates 325 and 326 (e.g., pressure sandwiching surfaces) that sandwich the booklet are flat surfaces in parallel to the transport centerline 301 similarly to the auxiliary sandwiching plates 320 and 321.

The contact plate 330 is disposed downstream from the sandwiching plates 325 and 326. The contact plate 330 and a contact plate driving unit 331 (shown in FIG. 18) to move the contact plate 330 vertically in FIG. 8 together form a contact unit. The contact plate 330 moves vertically in FIG. 8 to obstruct the transport path 302 and away from the transport path 302, and a reference position used in detecting a displacement of the contact plate 330 can be set with the output from the contact plate HP detector SN5. When the contact plate 330 is away from the transport path 302, a top surface of the contact plate 330 guides the booklet SB. Therefore, the top surface of the contact plate 330 is flat, in parallel to the sheet conveyance direction, that is, the transport centerline 301. For example, the contact plate driving unit 331 can include rack-and-pinions provided on both sides of the contact plate 330, that is, a front side and a back side of the spine formation device 3, and a driving motor to drive the pinions. With this configuration, the contact plate 330 can be moved vertically and set at a predetermined position by driving the driving motor.

Next, operations performed by the spine formation device 3 to flatten the folded portion, that is, the spine, of the booklet SB are described in further detail below referring to FIGS. 11 through 17. It is to be noted that reference character SB1 represents the folded portion (folded leading-edge portion) of the booklet SB.

In the spine formation according to the present embodiment, the spine of the booklet SB as well as the front cover side and the bock cover side thereof are flattened.

Figure 11:
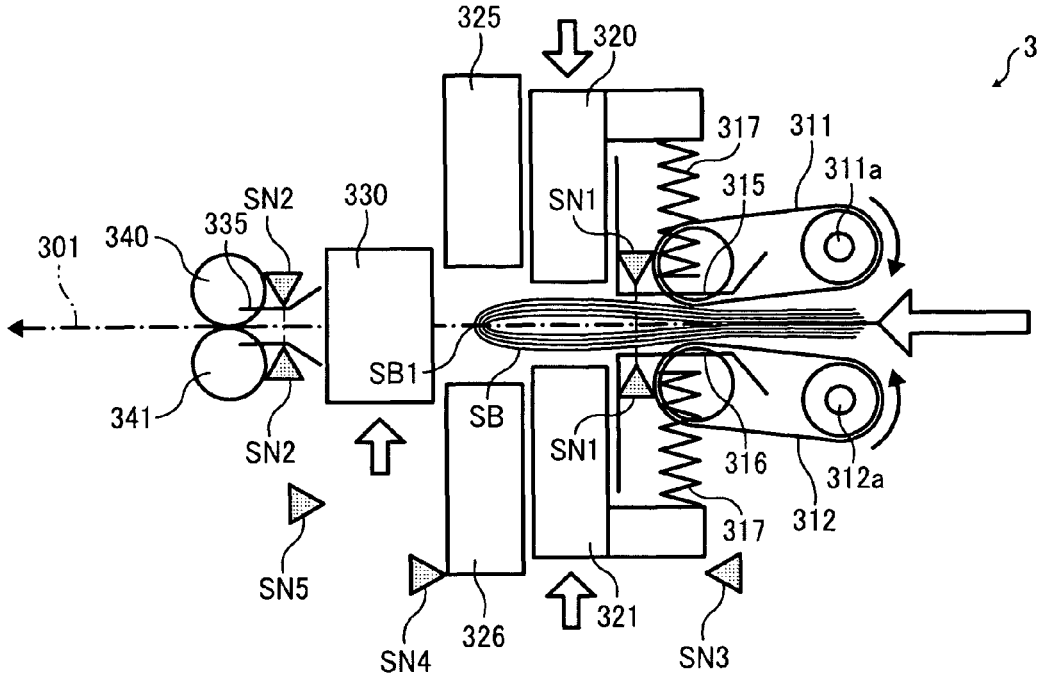
FIG. 11 illustrates a state of the spine formation device in which the bundle of folded sheets is transported therein.

FIG. 11 illustrates a state before the booklet SB enters the spine formation device 3.

Referring to FIG. 11, according to a detection signal of the booklet SB generated by an entrance sensor, not shown, of the spine formation device 3 or the folded portion detector 293 (shown in FIG. 7) of the bookbinding device 2, the respective portions of the spine formation device 3 perform preparatory operations to receive the booklet SB. In the preparatory operations, the pair of transport belts 311 and 312 starts rotating. Additionally, the upper auxiliary sandwiching plate 320 and the lower auxiliary sandwiching plate 321 move to the respective home positions detected by the auxiliary sandwiching plate HP detector SN3, move toward the transport centerline 301 until the distance (hereinafter "transport gap") therebetween becomes a predetermined distance, and then stop at those positions. Similarly, the upper sandwiching plate 325 and the lower sandwiching plate 326 move to the respective home positions detected by the sandwiching plate HP detector SN4, move toward the transport centerline 301 until the distance (transport gap) therebetween becomes a predetermined distance, and then stop at those positions.

It is to be noted that, because the pair of auxiliary sandwiching plates 320 and 321 as well as the pair of sandwiching plates 325 and 326 are disposed and move symmetrically relative to the transport centerline 301, when only one of the counterparts in the pair is detected at the home position, it is known that the other is at the home position as well. Therefore, the auxiliary sandwiching plate HP detector SN3 and the sandwiching plate HP detector SN4 are disposed on only one side of the transport centerline 301.

The contact plate 330 moves to the home position detected by the contact plate HP detector SN5, moves toward the transport centerline 301 a predetermined distance, and then stops at a position obstructing the transport path 302.

Figure 12:
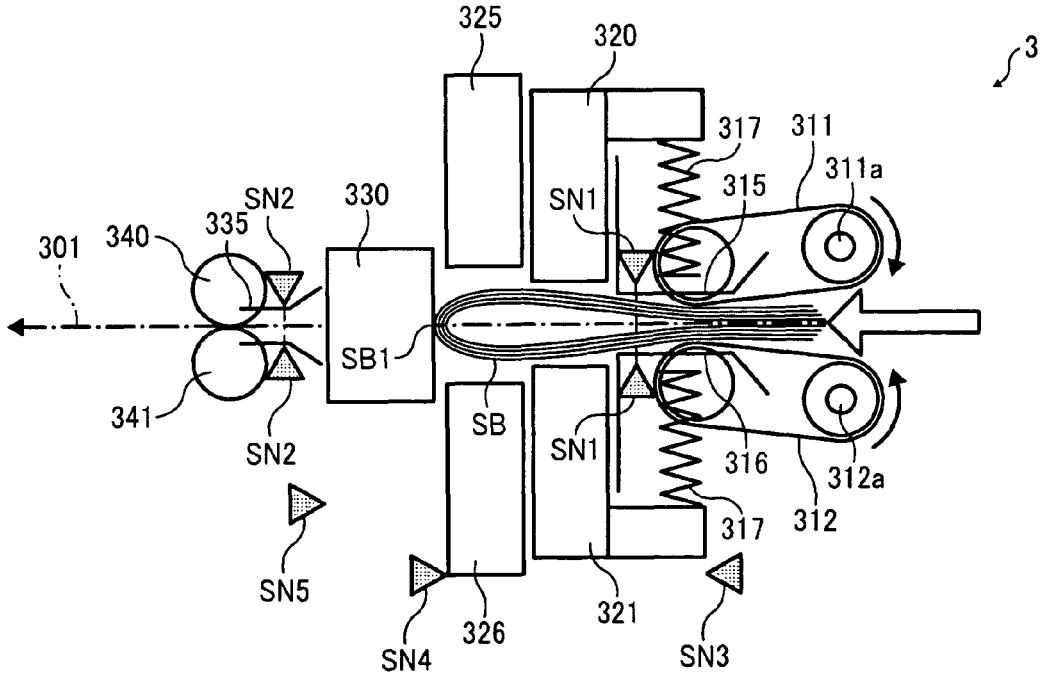
FIG. 12 illustrates a process of spine formation performed by the spine formation device in which the leading edge of the bundle of folded sheets is in contact with a contact plate.

In this state, when the booklet SB is forwarded by the discharge rollers 231 of the bookbinding device 2 to the spine formation device 3, the rotating transport belts 311 and 312 transport the booklet SB inside the device as shown in FIG. 11. The sheet detector SN1 detects the folded portion SB1 of the booklet SB, and then the booklet SB is transported the predetermined transport distance that is the sum of the first distance until the folded portion SB1 contacts the contact plate 330 and the predetermined distance from the contact position, necessary to form the spine by expanding the folded portion SB1 in the thickness direction, after which the booklet SB is kept at that position as shown in FIG. 12. The predetermined distance from the contact position can be determined according to the data relating to the booklet SB such as the thickness, the sheet size, the number of sheets, and the sheet type of the booklet SB.

Figure 13:
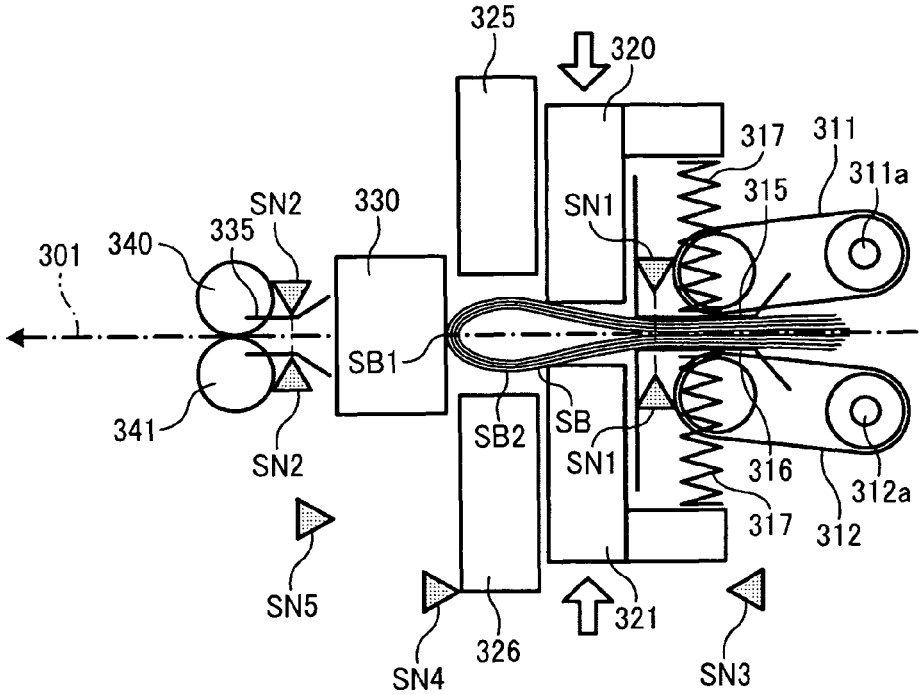
FIG. 13 illustrates a process of spine formation performed by the spine formation device in which a pair of auxiliary sandwiching plates approaches the bundle of folded sheets to sandwich it therein.
Figure 14:
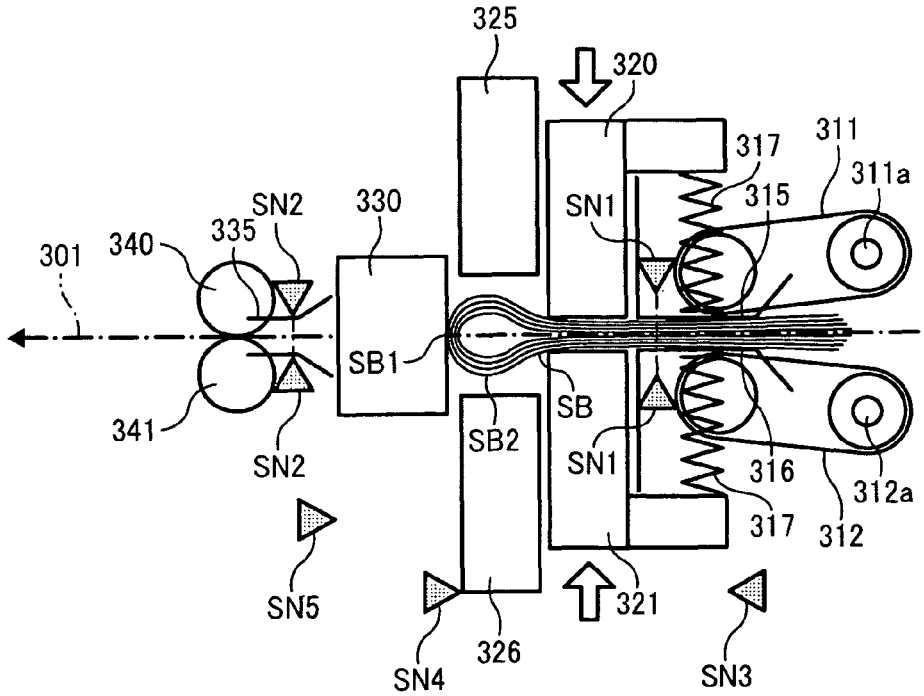
FIG. 14 illustrates a process of spine formation performed by the spine formation device in which the pair of auxiliary sandwiching plates squeezes the bundle of folded sheets.

When the booklet SB is stopped in the state shown in FIG. 12, referring to FIG. 13, the auxiliary sandwiching plates 320 and 321 start approaching the transport centerline 301, and the pair of guide plates 315 and 316 presses against the booklet SB sandwiched therein with the elastic force of the pressure springs 317 initially. In this state, a bulging portion SB2 is present upstream from the folded leading-edge portion SB1. After the pair of guide plates 315 and 316 applies a predetermined pressure to the booklet SB, the auxiliary sandwiching plates 320 and 321 further approach the transport centerline 301 to squeeze the booklet SB in the portion downstream form the portion sandwiched by the guide plates 315 and 316 and then stop moving when the pressure to the booklet SB reaches a predetermine or given pressure. Thus, the booklet SB is held with the predetermined pressure as shown in FIG. 14. With the folded leading-edge portion SB1 of the booklet SB pressed against the contact plate 330, the bulging portion SB2 upstream from the folded leading-edge portion SB1 is larger than that shown in FIG. 13.

Figure 15:
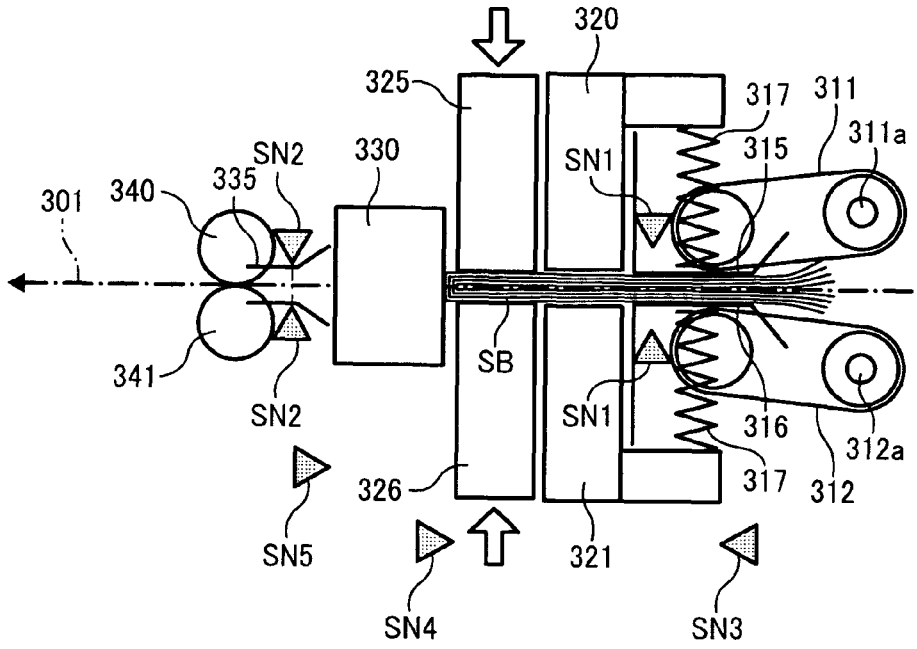
FIG. 15 illustrates a process of spine formation performed by the spine formation device in which a pair of sandwiching plates squeezes the bundle of folded sheets.

After the auxiliary sandwiching plates 320 and 321 squeeze the booklet SB as shown in FIG. 14, the sandwiching plates 325 and 326 start approaching the transport centerline 301 as shown in FIG. 15. With this movement, the bulging portion SB2 is localized to the side of the folded leading-edge portion SB1, pressed gradually, and then deforms following the shape of the space defined by the pair of sandwiching plates 325 and 326 and the contact plate 330. After this compressing operation is completed, the folded portion SB1 of the booklet SB is flat following the surface of the contact plate 330, and thus the flat spine is formed on the booklet SB. In addition, referring to FIG. 17, leading end portions SB3 and SB4 on the front side (front cover) and the back side (back cover) are flattened as well. Thus, booklets having square spines can be produced.

Figure 16:
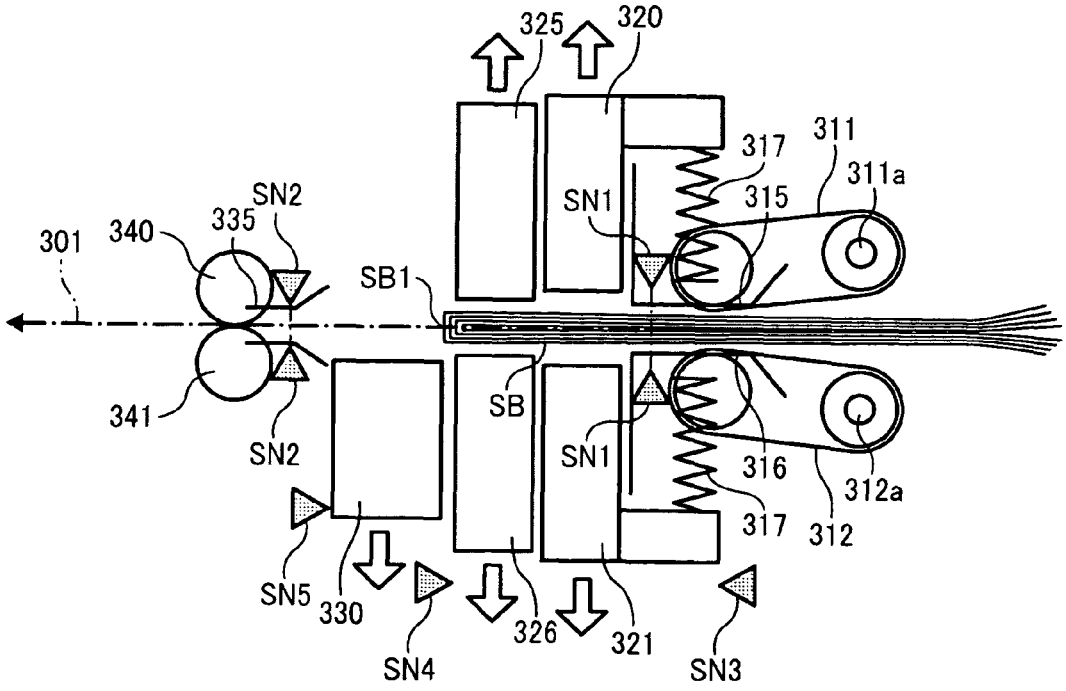
FIG. 16 illustrates completion of spine formation performed by the spine formation device in which the pair of auxiliary sandwiching plates and the pair of sandwiching plates are disengaged from the bundle of folded sheets.

Subsequently, as shown in FIG. 16, the auxiliary sandwiching plates 320 and 321 and the sandwiching plates 325 and 326 move away from the booklet SB to predetermined or given positions (standby positions), respectively. The contact plate 330 moves toward the home position and stops at a position where the top surface thereof guides the booklet SB.

Figure 17:
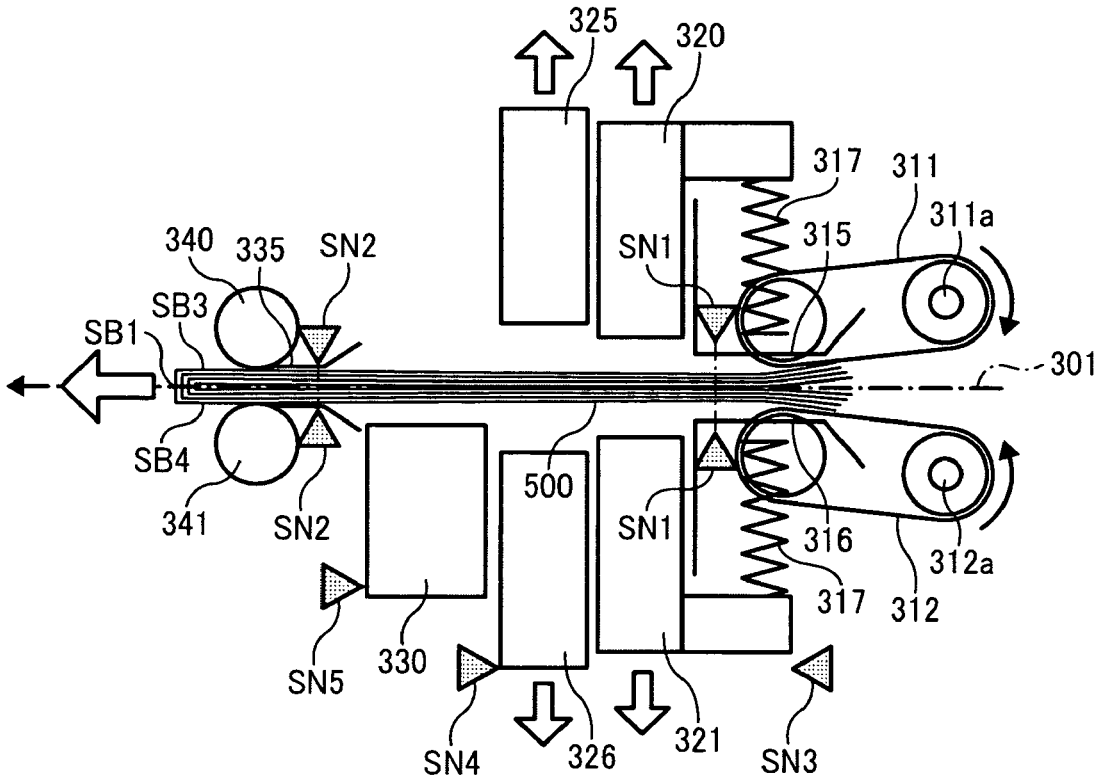
FIG. 17 illustrates a state in which the bundle of folded sheets is discharged from the spine formation device after spine formation.

After the auxiliary sandwiching plates 320 and 321, the sandwiching plates 325 and 326, and the contact plate 330 reach the respective standby positions, as shown in FIG. 17, the transport belts 311 and 312 and the pair of discharge rollers 340 and 341 start rotating, thereby discharging the booklet SB outside the spine formation device 3. Thus, a sequence of spine formation operations is completed. The transport belts 311 and 312 and the pair of discharge rollers 340 and 341 stop rotating after a predetermined time period has elapsed from the detection of the booklet SB by the discharge detector N2. Simultaneously, the respective movable portions return to their home positions. When subsequent booklets SB are sequentially sent form the bookbinding device 2, the time point at which the rotation of the transport belts 311 and 312 and the discharge rollers 340 and 341 is stopped is varied according to the transport state of the subsequent booklet SB. Additionally, it may be unnecessary to return the respective movable portions to their home positions each time, and the position to receive the booklet SB may be varied according to the transport state of and the data relating to the subsequent booklet SB. It is to be noted that the above-described CPU2-1 of the bookbinding device 2 performs these adjustments.

A control block of the bookbinding system is described below with reference to FIG. 18.

Figure 18:
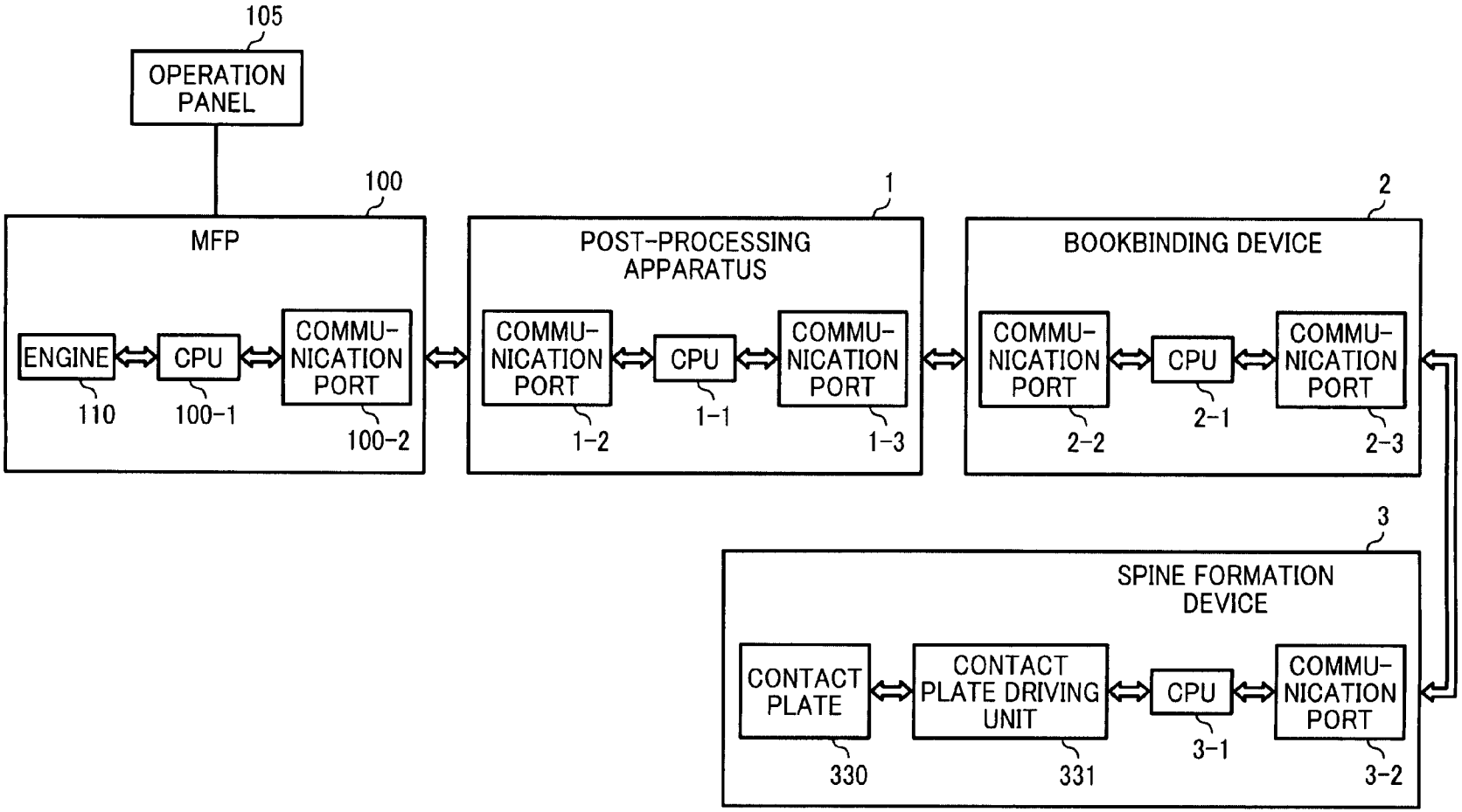
FIG. 18 is a block diagram illustrating a configuration of online control of the bookbinding system.

FIG. 18 is a block diagram illustrating a configuration of online control of the bookbinding system.

The post-processing apparatus 1 is connected to the image forming apparatus (MFP) 100, and the bookbinding device 2 is connected to the post-processing apparatus 2. Further, the spine formation device 3 is connected to the bookbinding device 2. The MFP 100, the post-processing apparatus 1, the bookbinding device 2, and the spine formation device 3 respectively include the CPUs 100-1, 1-1, 2-1, and 3-1. The MFP 100 further includes an engine 110 and a communication port 100-2. The post-processing apparatus 1 further includes communication ports 1-2 and 1-3, the binding device 2 further includes communication ports 2-2 and 2-3, and the spine formation device 3 further includes a communication port 3-2. The MFP 1 and the post-processing apparatus 1 can communicate with each other using the communication ports 100-2 and 1-2, and post-processing apparatus 1 and the bookbinding device 2 can communicate with each other using the communication ports 1-3 and 2-2. Similarly, the bookbinding device 2 and the spine formation device 3 can communicate with each other using the communication ports 2-3 and 3-2. Additionally, the CPU 100-1 of the MFP 100 controls indications on the operation panel 105 and inputs from users to the operation panel 105, and thus the operation panel 105 serves as a user interface.

Each of the MFP 100, the post-processing apparatus 1, the bookbinding device 2, and the spine formation device 3 further includes a read-only memory (ROM) and a random-access memory (RAM). Each of the CPUs 100-1, 1-1, 2-1, and 3-1 thereof reads out program codes from the ROM, runs the program codes in the RAM, and then performs operations defined by the program codes using the RAM as a work area and a data buffer. With this configuration, various control and operations described above or below are performed. The MFP 100, the post-processing apparatus 1, the bookbinding device 2, and the spine formation device 3 are connected in line via the communication ports 100-2, 1-2, 1-3, 2-2, 2-3, and 3-2. When post-processing of sheets is performed online, the post-processing apparatus 1, the bookbinding device 2, and the spine formation device 3 communicate with the CPU 100-1 of the MFP 100, and thus the post-processing of sheets is controlled by the CPU 100-1 of the MFP 100.

It is to be noted that, in this specification, "inline processing" means that at least two of image formation, processing of sheets, stapling of a bundle of sheets, and spine formation of the booklet are performed sequentially while the sheets are transported through the bookbinding system.

Referring to FIGS. 19 through 24, a shape of the contact surface of the contact plate 330 is described below.

Figure 19:
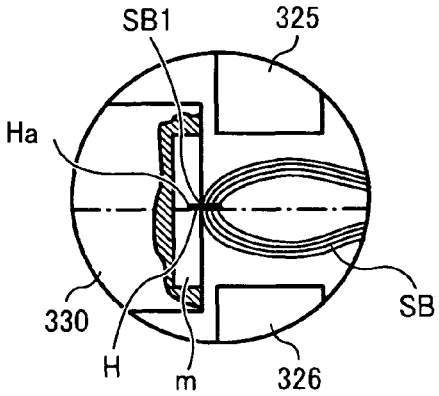
FIG. 19 is a cross-sectional diagram illustrating a state in which the folded leading-edge portion of the booklet is pressed against the contact plate.

FIG. 19 is a cross-sectional diagram illustrating a state in which the folded leading-edge portion SB1 of the booklet SB is pressed against the contact plate 330.

As shown in FIG. 19, in a portion where a staple H binds the booklet SB, the staple H projects from the spine of the booklet SB. The amount by which the staple H projects from the spine of the booklet SB equals to the thickness of the staple H at the least.

In other words, when the booklet SB is folded, a portion Ha of the staple H projects from the spine of the booklet SB (hereinafter "projecting portion Ha"). Therefore, in the present embodiment, grooves m are provided in the contact surface 330*a* of the contact plate 330 so that the projecting portion Ha of the staple H can enter the groove m, thus enabling the spine of the booklet SB to press against the contact surface 300*a* of the contact plate 330. With this configuration, even when the projecting portion Ha of the staple H projects from the spine of the booklet SB, no steps are created by the projecting portion Ha when the spine of the booklet SB is pressed against the contact plate 330. Therefore, it is preferable that the groove m have a depth equal to the thickness of the staple H at the least, for example.

Figure 20:
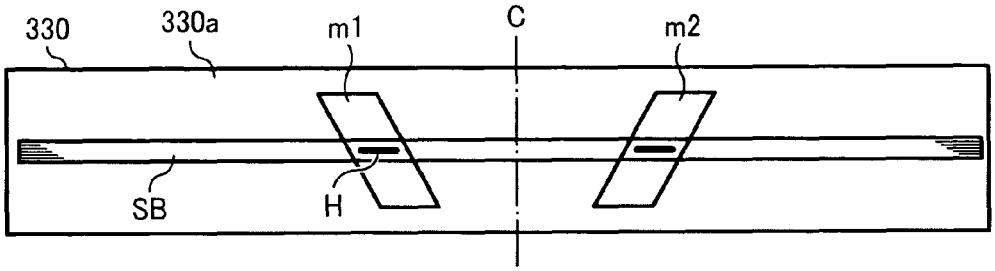
FIG. 20 illustrates grooves formed in the contact surface of the contact plate for two-position stapling.

Additionally, as shown in FIG. 20, the grooves m (m1 and m2) provided in the contact surface 330*a* of the contact plate 330 are oblique to a direction parallel to the folded front edge of the booklet SB, that is, the longitudinal direction of the staple H, and the contact plate 330 is movable vertically as described above with reference to FIG. 11 or 17. With this configuration, by forming the two oblique grooves m1 and m2 that are symmetrical relative to a centerline C of the contact plate 330 in the horizontal direction (main scanning direction) in FIG. 20, the distance between the grooves m1 and m2 can be changed with the vertical position of the contact plate 330. In other words, when the booklet SB is bound with two staples, the positions of the grooves m1 and m2 can be changed according to the size of interval between the two staples in the main scanning direction. In FIG. 20, the higher the contact plate 330 is positioned, the narrower the interval between the two grooves m1 and m2.

Figure 21:
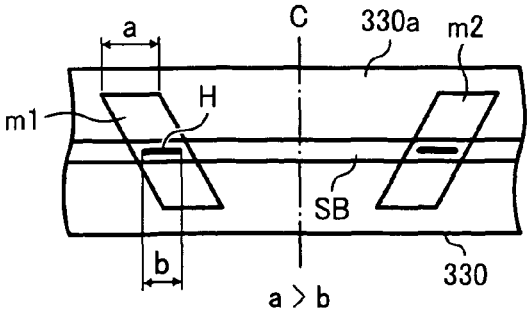
FIG. 21 illustrates the relation between the grooves shown in FIG. 20 and the staples.

FIG. 21 illustrates the relation between the grooves m and the staples H in further detail.

As shown in FIG. 21, the grooves m (m1 and m2) have a width a greater than a width b of the staples H (a>b). This relation can eliminate interference between the staples H and the grooves m.

Additionally, referring to FIG. 22, with the ratio of a horizontal length c and a vertical length d of the grooves m, the rate of changes in the distance X1 between the grooves m according to the distance by which the contact plate 330 moves vertically (hereinafter "vertical travel distance") can be adjusted. For example, in the configuration shown in FIG. 22, the horizontal length c and the vertical length d of the grooves m satisfies c:d=1:2. By using the vertical travel distance of the contact plate 330 as a variable, the distance X1 can be calculated.

Figure 23:
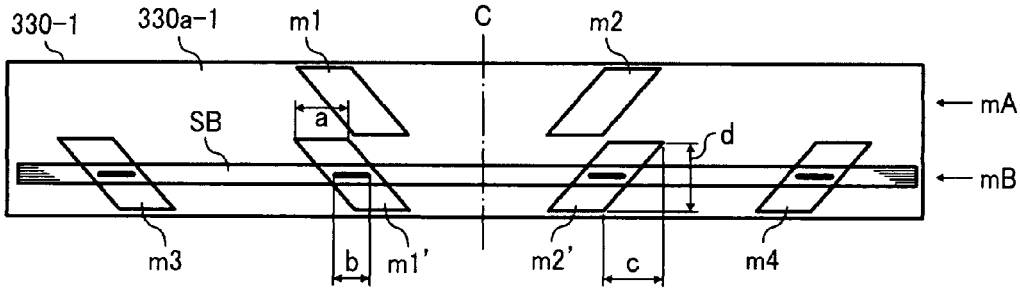
FIG. 23 illustrates a contact plate having a contact surface in which grooves for two-position stapling as well as those for four-position stapling are formed.

FIG. 23 illustrates a configuration of a contact plate 330-1 including grooves to accommodate both two-position stapling and four-position stapling meaning stapling a bundle of sheets at two positions and at four positions, respectively.

Figure 22:
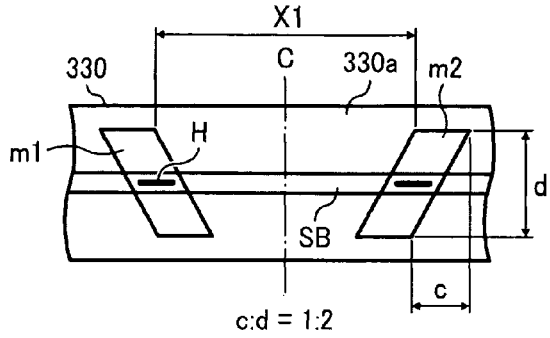
FIG. 22 illustrates the ratio between a horizontal length and a vertical length of the grooves shown in FIG. 21.

Referring to FIG. 23, a contact surface 330*a*-1 of the contact plate 330-1 includes a groove line (first row of grooves) mA consisting of the grooves m1 and m2 shown in FIG. 22 to correspond to two-position stapling and a groove line (second row of grooves) mB corresponding to four-position stapling, positioned beneath the groove line mA. The groove line mB includes a grooves m3, m1', m2', and m4 in that order from the left in FIG. 23, and the grooves m1' and m2' are identical or similar to grooves m1 and m2 in the groove line mA for two-position stapling. Also in the groove line mB, two grooves m3 and m1' and the other two grooves m2' and m4 are symmetrical relative to the centerline C of the contact plate 330-1 in the horizontal direction. Additionally, in the groove line mB, the relation between the width a of the grooves m and the width b of the staples H is similar to that shown in FIG. 21 (a>b) and the relation between the horizontal length c and the vertical length d of the grooves m is similar to that shown in FIG. 22 (c:d=1:2).

This configuration enables, according to the vertical position of the contact plate 330-1, adjustment of the number of the grooves m (in FIG. 23, two or four) formed in a portion facing the folded leading edge (spine) of the booklet SB as well as the size of interval between the grooves m corresponding to the interval between the staples H.

It is to be noted that, in the configuration shown in FIG. 23, although the interval between the grooves m1' and m2' and that between the grooves m3 and m4 are adjustable, the interval between the grooves m1' and m3 and that between the m2' and m4 are constant. By contrast, FIG. 24 illustrates a configuration of a contact plate 330-2 including a groove line mC (third row of grooves) in addition to the groove lines mA and mB so that the size of interval between the grooves are more adjustable.

Figure 24:
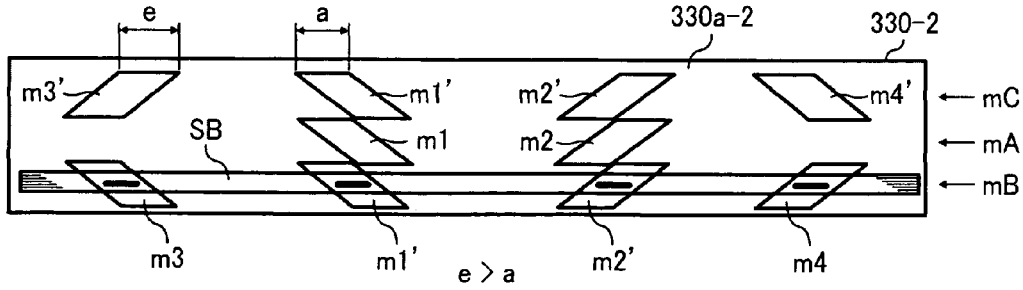
FIG. 24 illustrates another contact plate having a contact surface in which grooves for two-position stapling as well as those for four-position stapling are formed.

More specifically, in FIG. 24, the groove line mC includes grooves m3' and m4' that are inverted by 180 degrees from the grooves m3 and m4 in the groove line mB for four-position stapling and is positioned above the groove line mA for two-position stapling. The groove line mC includes grooves m1' and m2' identical or similar to the grooves m1 and m2 in addition to the grooves m3' and m4'. With this configuration, each of two cases in which the interval between the grooves m1' and m2' is longer and shorter can have two patterns in which the interval between the grooves m1' and m3 and that between the grooves 2' and m4 are longer and shorter, respectively. Additionally, when a width e, that is, the horizontal length in FIG. 24, of the grooves m3 (m3') and m4 (m4') is designed longer by about 2 mm than the width a of the grooves m1' and m2' (e>a), the interval between the grooves m1' and m3 and that between the grooves 2' and m4 are finely adjustable. It is to be noted that, although the groove m1' parallels the groove m3 and the groove m2' parallels the groove m4 in FIGS. 23 and 24, alternatively, inclination of them may be different.

Figure 25:
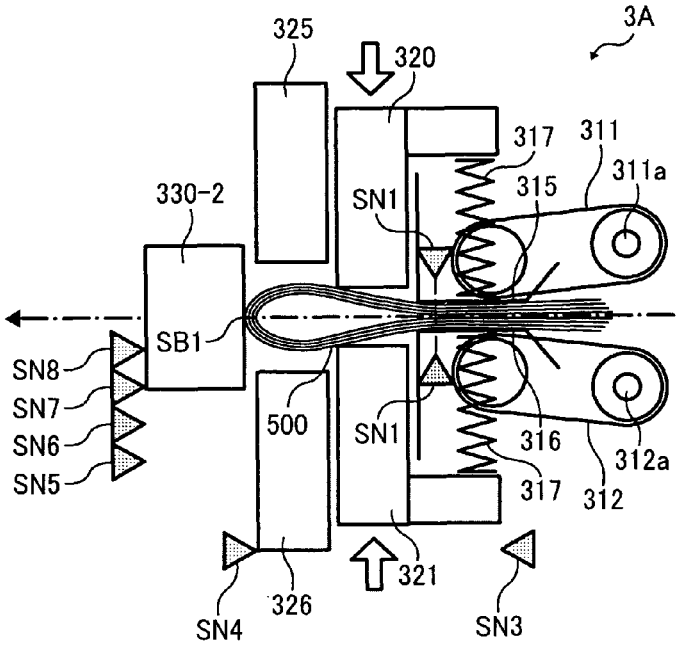
FIG. 25 is a front view illustrating a configuration of a spine formation device including the contact plate shown in FIG. 24.

FIG. 25 is a front view illustrating a configuration of a spine formation device 3A including the contact plate 330-2 shown in FIG. 24. The spine formation device 3A shown in FIG. 25 has a configuration similar to that shown in FIG. 12 except that position detectors SN6 through SN8 are added, and thus the descriptions of the similar portions are omitted.

In the spine formation device 3A shown in FIG. 25, according to detection by the position detectors SN5 through SN8, the vertical position (height) of the contact plate 330-2 against which the spine of the booklet SB is pressed is recognized.

Figure 26:
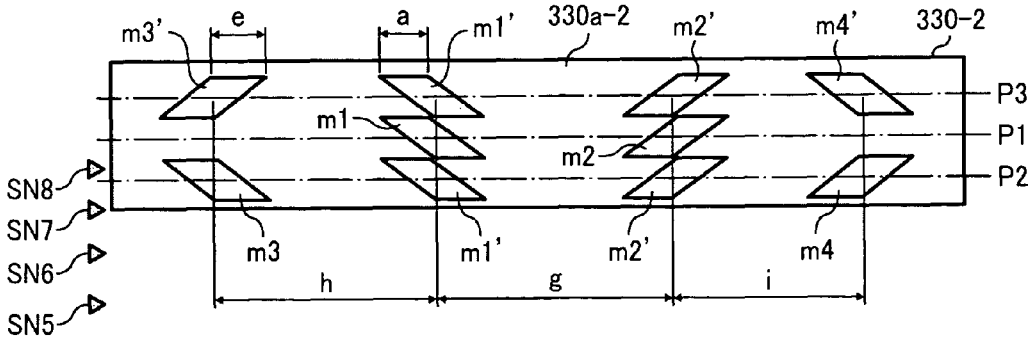
FIG. 26 illustrates relations among the positions of the grooves, the intervals between the grooves, and the vertical position of the contact plate shown in FIG. 24.

FIG. 26 illustrates relations among the positions of the grooves, the size of interval between the grooves, and the vertical position of the contact surface 330*a*-2 of the contact plate 330-2. In FIG. 26, reference characters g, h, and i respectively represent intervals between centers in the main scanning direction (horizontal direction) of the grooves m3 and m1', that between the grooves m1 and m2 (m1' and m2'), and that between the grooves m2' and m4.

In FIG. 26, the intervals h, g, and i between the grooves m3 and m1', the grooves m1 and m2, and the grooves m2' and m4 in the main scanning direction are respectively identical at positions P1, P2, and P3, and these positions are used as reference positions (center values) of the staples H. The position P1 is set based on detection by the position detector SN7, the position P2 is set based on detection by the position detector SN8, and the position P3 is set based on detection by the position detector SN6.

Based on the above-described configuration, positional adjustment of the contact plate 330-2 is described below.

1) Adjustment for Two-Position Stapling

Figure 27:
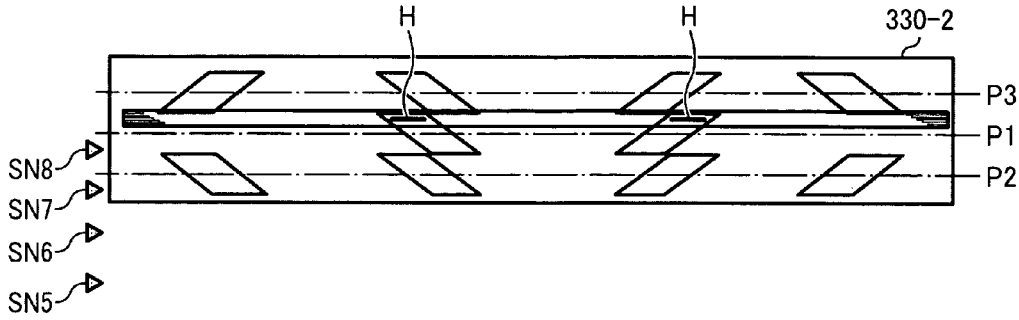
FIG. 27 illustrates positional adjustment of the contact plate for two-position stapling in which the contact plate is moved up.
Figure 28:
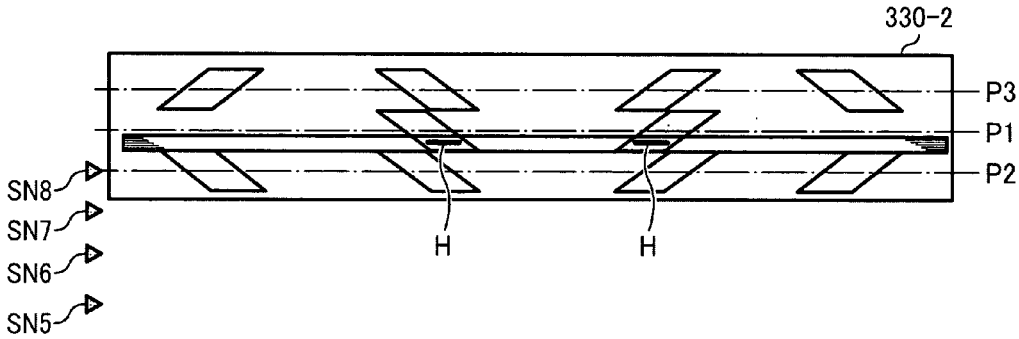
FIG. 28 illustrates positional adjustment of the contact plate for two-position stapling in which the contact plate is moved down.

When stapling the booklet SB with two staples H is selected, the standby position of the contact plate 330-2 is the position P1, and the contact plate 330-2 is moved up as shown in FIG. 27 when the interval between the two staples H is longer and is moved down as shown in FIG. 28 when the interval is shorter. The distance by which the contact plate 330-2 is moved vertically from the position P1 depends on the inclination of the grooves. For example, when the ratios of the horizontal length and the vertical length of the grooves are 1:2 as described above and the interval between the staples H is longer by 1 mm than the reference value, the contact plate 330-2 is moved down 2 mm from the position P1. It is to be noted that the CPU 3-1 of the above-described control circuit performs these adjustments.

Similarly, when the size of interval between the staples H differs depending on staple size, the distance between the grooves is set by moving the contact plate 330-2 up or down from the position P1 based on the interval between the staples H at the position P1.

2) Adjustment for Four-Position Stapling

Figure 29:
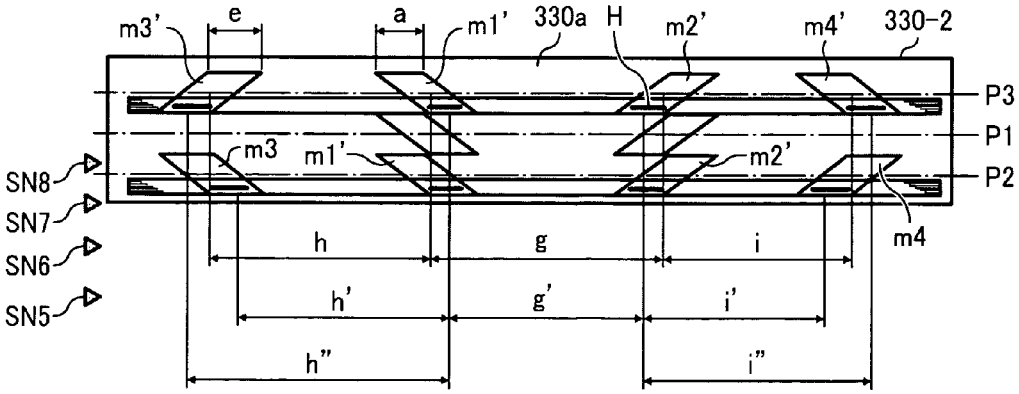
FIG. 29 illustrates positional adjustment of the contact plate for four-position stapling.

As shown in FIG. 29, in adjustment for four-position stapling, the inner interval g between the grooves m1' and m2' is adjustable between a distance g and a distance g', and, for the inner interval g, the outer intervals h is adjustable between a distance h' and a distance h" and the other outer interval i is adjustable between a distance i' and a distance i". In this configuration, the interval between the outer groove and the inner groove is identical or similar on both sides. That is, the distance h equals the distance i. More specifically, the user sets the inner interval g based on the distance between the inner staples H and then decides the outer intervals h and i settable at that time. Thus, the vertical position of the contact plate 330-2 is set. Since the width e of the outer groove m3 or m3' is greater than the width a of the inner groove m1' (e>a), the distances h and i can be adjusted finely. More specifically, the adjustment amount of the outer intervals h and i when the inner interval is determined according to the inner staples H is greater than the adjustment amount of the inner interval g. Therefore, the shorter distance h' or i' and the longer distance h" or i" are determined to enable this adjustment amount. That is, the maximum adjustment amount of the outer interval h is h"−h'. Then, the contact plate 330-2 is moved up or down from the position P2 or P3 and thus is set to the vertical position determined based on the intervals among the staples H similarly to the above-described adjustment for two-position stapling.

As described above, multiple grooves are formed in the contact surface 330-*a* of the contact plate 330 to house the projecting staples H, thereby eliminating steps formed by the staples H on the spine of the booklet. Therefore, steps between the spine of the booklet SB and the contact surface

330*a* of the contact plate 330 can be reduced or eliminated, thus improving the appearance of the spine of the booklet.

It is to be noted that, although grooves are used to reduce the steps between the spine of the booklet and the contact plate in the above-described embodiment, alternatively, elastic materials such as rubber or sponge may be provided on the contact surface of the contact plate in portions pressed against staples to prevent the staples from being buried in the spine of the booklet. In this case, effects similar to those in the configuration using grooves can be attained.

It is to be noted that, in the above-described two types of adjustment of the vertical position of the contact plate, the CPU 3-1 of the staples spine formation device 3 selects the grooves according to positional data of the staples transmitted from the CPU 2-1 of the bookbinding device 2. Similarly, the CPU 3-1 of the staples spine formation device 3 adjusts the intervals between the grooves according to sheet size data of the booklet SB and changes the number of the grooves according to the number of the staples or the number of binding position, which is two or four in the above-described embodiment, transmitted from the CPU 2-1 of the bookbinding device 2.

Additionally, the contact plate driving unit 331 (shown in FIG. 18) may be configured to move the contact plate 330 in the direction in which the spine of the booklet extends in addition to the vertical direction in figures to correspond to changes in the position of the stapes binding the booklet in addition to the size of interval therebetween.

Numerous additional modifications and variations are possible in light of the above teachings. It is therefore to be understood that, within the scope of the appended claims, the disclosure of this patent specification may be practiced otherwise than as specifically described herein.

What is claimed is:

1. A spine formation device comprising:

a sheet conveyer that conveys a bundle of folded sheets in a sheet conveyance direction with a folded portion of the bundle of folded sheets forming a front end portion of the bundle of folded sheets;

a contact member disposed downstream from the sheet conveyer in the sheet conveyance direction, the contact member including, a contact surface extending in a first direction perpendicular to the sheet conveyance direction, against which the folded portion of the bundle of folded sheets is pressed, and a first row of grooves to house a projection projecting from the folded portion of the bundle of folded sheets, provided in the contact surface, extending in a second direction parallel to the folded portion of the bundle of folded sheets, the first row of grooves including at least a first pair of grooves inclined in different directions with an interval therebetween varying in size with location of the grooves in the first direction;

a driving unit to move the contact member in the first direction relative to the folded portion of the bundle of folded sheets;

a first sandwiching unit disposed downstream from the sheet conveyer in the sheet conveyance direction, the first sandwiching unit squeezing the bundle of folded sheets in a direction of thickness of the bundle of folded sheets with the folded portion pressed against the contact member;

a second sandwiching unit disposed downstream from the first sandwiching unit in the sheet conveyance direction, the second sandwiching unit forming a spine of the bundle of folded sheets by squeezing a bulging of the bundle of folded sheets created between the first sandwiching unit and the contact member;

a discharge unit to discharge the bundle of folded sheets to a discharge tray; and a controller operatively connected to the sheet conveyer, to the first and second sandwiching units, and to the driving unit, the controller causing the driving unit to move the contact member to change the size of interval between the first pair of grooves at a position in the first direction, aligned with the projection projecting from the folded portion of the bundle of folded sheets.

2. The spine formation device according to claim 1, wherein the first pair of grooves consists of two symmetrical grooves.

3. The spine formation device according to claim 1, wherein the controller changes the size of interval between the first pair of grooves at the position in the first direction, aligned with the projection projecting from the folded portion of the bundle of folded sheets, by moving the contact member in the first direction in accordance with position data of a binding member binding the bundle of folded sheets.

4. The spine formation device according to claim 1, wherein the controller changes the size of interval between the first pair of grooves at the position in the first direction, aligned with the projection projecting from the folded portion of the bundle of folded sheets, by moving the contact member in the first direction in accordance with sheet size data of the bundle of folded sheets.

5. The spine formation device according to claim 1, wherein the contact member further comprises a second row of grooves of greater or lesser number than the number of grooves in the first row of grooves, formed in the contact surface and arranged in parallel to the first row, and the controller positions the contact member with either the first row of grooves or the second row of grooves aligned with the folded portion of the bundle of folded sheets according to a number of binding members binding the bundle of folded sheets.

6. The spine formation device according to claim 1, wherein the first row of grooves further comprises a second pair of grooves, each of the first and second pairs of grooves consists of two symmetrical grooves, and a counterpart of the first pair of grooves and a counterpart of the second pair of grooves adjacent thereto are inclined in an identical direction.

7. The spine formation device according to claim 6, wherein the contact member further comprises a third row of grooves formed in the contact surface thereof, arranged in parallel to the first row of grooves, and the third row of grooves includes a third pair of grooves identical to the first pair of grooves, positioned in an identical position in the second direction to that of the first pair of grooves, and a fourth pair of grooves symmetrical with the second pair of grooves.

8. The spine formation device according to claim 1, wherein the first row of grooves further comprises a second pair of grooves, disposed outside the first pair of grooves in the second direction, each of the first and second pairs of grooves consists of two symmetrical grooves, and the two grooves forming the second pair of grooves have a length in the second direction longer than that of the first pair of grooves.

9. A post-processing apparatus comprising:

a saddle-stapler to staple a bundle of sheets together along a centerline of the bundle;

a folding unit to fold the bundle of sheets along the centerline of the bundle; and a spine formation device to flatten a folded portion of the bundle of folded sheets, the spine formation device comprising:

a sheet conveyer that conveys the bundle of folded sheets in a sheet conveyance direction with the folded portion of the bundle of folded sheets forming a front end portion of the bundle of folded sheets;

a contact member disposed downstream from the sheet conveyer in the sheet conveyance direction, the contact member including, a contact surface extending in a first direction perpendicular to the sheet conveyance direction, against which the folded portion of the bundle of folded sheets is pressed, and a first row of grooves to house a projection projecting from the folded portion of the bundle of folded sheets, provided in the contact surface, extending in a second direction parallel to the folded portion of the bundle of folded sheets, the first row of grooves including at least a first pair of grooves inclined in different directions with an interval therebetween varying in size with location of the grooves in the first direction;

a driving unit to move the contact member in the first direction relative to the folded portion of the bundle of folded sheets;

a first sandwiching unit disposed downstream from the sheet conveyer in the sheet conveyance direction, the first sandwiching unit squeezing the bundle of folded sheets in a direction of thickness of the bundle of folded sheets with the folded portion pressed against the contact member;

a second sandwiching unit disposed downstream from the first sandwiching unit in the sheet conveyance direction, the second sandwiching unit forming a spine of the bundle of folded sheets by squeezing a bulging of the bundle of folded sheets created between the first sandwiching unit and the contact member;

a discharge unit to discharge the bundle of folded sheets to a discharge tray; and a controller operatively connected to the sheet conveyer, to the first and second sandwiching units, and to the driving unit, the controller causing the driving unit to move the contact member to change the size of interval between the first pair of grooves at a position in the first direction, aligned with the projection projecting from the folded portion of the bundle of folded sheets.

10. A bookbinding system comprising:

an image forming apparatus; and a post-processing apparatus to perform post processing of sheets transported from the image forming apparatus, the post-processing apparatus comprising:

a saddle-stapler to staple a bundle of sheets together along a centerline of the bundle;

a folding unit to fold the bundle of sheets along the centerline of the bundle; and a spine formation device to flatten a folded portion of the bundle of folded sheets, the spine formation device comprising:

a sheet conveyer that conveys the bundle of folded sheets in a sheet conveyance direction with the folded portion of the bundle of folded sheets forming a front end portion of the bundle of folded sheets;

a contact member disposed downstream from the sheet conveyer in the sheet conveyance direction, the contact member including a contact surface extending in a first direction perpendicular to the sheet conveyance direction, against which the folded portion of the bundle of folded sheets is pressed, and a row of grooves to house a projection projecting from the folded portion of the bundle of folded sheets, provided in the contact surface, extending in a second direction parallel to the folded portion of the bundle of folded sheets, the row of grooves including at least a pair of grooves inclined in different directions with an interval therebetween varying in size with location of the grooves in the first direction;

a driving unit to move the contact member in the first direction relative to the folded portion of the bundle of folded sheets;

a first sandwiching unit disposed downstream from the sheet conveyer in the sheet conveyance direction, the first sandwiching unit squeezing the bundle of folded sheets in a direction of thickness of the bundle of folded sheets with the folded portion pressed against the contact member;

a second sandwiching unit disposed downstream from the first sandwiching unit in the sheet conveyance direction, the second sandwiching unit forming a spine of the bundle of folded sheets by squeezing a bulging of the bundle of folded sheets created between the first sandwiching unit and the contact member;

a discharge unit to discharge the bundle of folded sheets to a discharge tray; and a controller operatively connected to the sheet conveyer, to the first and second sandwiching units, and to the driving unit, the controller causing the driving unit to move the contact member to change the size of interval between the pair of grooves at a position in the first direction, aligned with the projection projecting from the folded portion of the bundle of folded sheets.

* * * * *